US008162464B2

(12) United States Patent
Nomura et al.

(10) Patent No.: US 8,162,464 B2
(45) **Date of Patent: *Apr. 24, 2012**

(54) LIQUID EJECTION APPARATUS AND LIQUID PROCESSING METHOD

(75) Inventors: Hiroyasu Nomura, Tokyo (JP); Makoto Shihoh, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 981 days.

This patent is subject to a terminal disclaimer.

(21) Appl. No.: 12/213,228

(22) Filed: Jun. 17, 2008

(65) Prior Publication Data

US 2008/0259145 A1 Oct. 23, 2008

Related U.S. Application Data

(62) Division of application No. 11/085,123, filed on Mar. 22, 2005, now Pat. No. 7,399,075.

(30) Foreign Application Priority Data

Mar. 23, 2004 (JP) ..... 2004-085600
Feb. 21, 2005 (JP) ..... 2005-044246

(51) Int. Cl.
*B41J 2/18* (2006.01)

(52) U.S. Cl. ..... 347/89; 347/85; 347/90; 347/6

(58) Field of Classification Search ..... 347/89, 347/85, 90, 6

See application file for complete search history.

(56) References Cited

U.S. PATENT DOCUMENTS

| | | | | |
|---|---|---|---|---|
| 4,399,446 | A | 8/1983 | McCann et al. | 347/89 |
| 4,462,037 | A | 7/1984 | Bangs et al. | 347/85 |
| 4,680,696 | A | 7/1987 | Ebinuma et al. | 347/85 |
| 4,947,191 | A | 8/1990 | Nozawa et al. | 347/30 |
| 5,220,345 | A | 6/1993 | Hirosawa | 347/17 |
| 5,561,448 | A | 10/1996 | Kaneko et al. | 347/29 |
| 5,886,718 | A | 3/1999 | Johnson et al. | 347/85 |
| 6,082,851 | A | 7/2000 | Shihoh et al. | 347/85 |
| 6,231,174 | B1 | 5/2001 | Haigo | 347/89 |
| 6,293,662 | B1 | 9/2001 | Shihoh et al. | 347/86 |
| 6,428,156 | B1 | 8/2002 | Waller et al. | 347/89 |
| 6,431,699 | B2 | 8/2002 | Shihoh et al. | 347/86 |
| 6,561,637 | B2 | 5/2003 | Hino | 347/92 |
| 7,399,075 | B2 * | 7/2008 | Nomura et al. | 347/89 |

FOREIGN PATENT DOCUMENTS

| | | |
|---|---|---|
| DE | 196 31 157 | 3/1997 |
| EP | 916502 | 5/1999 |
| EP | 1234674 | 8/2002 |
| JP | 10-315491 | 12/1998 |
| JP | 11-179932 | 7/1999 |

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

In order to prevent, in an operation for circulating liquid, an ejection port from sucking air or the ejection port from pushing out liquid, the subtank for temporally storing ink to be supplied to the ink jet head includes the air communication passage opened or closed by the air communication valve. The ink jet head is communicated with the subtank by the first passage and the second passage to constitute one circulation passage. In order to circulate the ink in the subtank into the common liquid chamber, the main pump is energized while the air communication valve is being closed. When the circulation operation is stopped, the air communication valve is opened immediately after the stoppage of the main pump, thereby eliminating the differential pressure between the common liquid chamber and the subtank within a short period of time.

8 Claims, 15 Drawing Sheets

LIQUID EJECTION APPARATUS AND LIQUID PROCESSING METHOD

This application is a divisional of U.S. patent application Ser. No. 11/085,123, filed Mar. 22, 2005, now U.S. Pat. No. 7,399,075, issued on Jul. 15, 2008, the contents of which are incorporated by reference herein.

BACKGROUND OF THE INVENTION

1. Field of the Invention

The present invention relates to a liquid ejection apparatus incorporating a supplying liquid circulation system for circulating liquid in a liquid ejecting head and the liquid processing method thereof. In particular, the present invention is suitable as an ink jet apparatus using a full line-type ink jet head in which ejection ports are arranged over the entire width of a printing medium.

The term "print" described in the Specification includes, in addition to a case where significant information (e.g., characters, graphic) is formed, variety of cases such as a case where an image, marking, or pattern is formed on a printing medium or a case where the printing medium is processed (e.g., etching), regardless of the significance or non-significance and regardless of whether or not the information is elicited so as to be visually recognized by a person.

The term "printing medium" includes not only a paper used in a general print apparatus but also materials (e.g., cloth, resin film, metal plate, glass, ceramics, wood, leather) that can accept liquid and materials having a three-dimensional shape other than a sheet-like shape (e.g., sphere, cylindrical body).

The term "liquid" should be widely interpreted as in the case of the definition of the above term "print" and includes any liquids used for printing such as liquid applied to a printing medium to be used for the formation of an image, marking, pattern or the like, liquid for the processing of a printing medium (e.g., etching), or liquid for the processing of ink (e.g., liquid that can be used so that color material in ink applied to a printing medium has coagulation or encapsulation)

2. Description of Related Art

In an ink jet print apparatus, ink is ejected from an ink jet head (hereinafter also referred to as "print head") so that the ink is applied to a printing medium for printing, for example. The ink jet print apparatus is advantageous in that the print head can have a compact body in an easy manner, a high-definition image can be printed with a high speed, the running cost is low, the non-impact method reduces noise, and inks having a number of colors are used to print a color image in an easy manner, for example. The so-called full line-type ink jet head is particularly advantageous because a number of ejection ports are arranged over the entire width of the image formation region of a printing medium so that the ejection ports can eject ink simultaneously to form an image with a higher speed. The full line-type print head includes a number of ejection ports arranged in a longitudinal direction and thus a common liquid chamber for storing ink supplied to the respective ejection ports also has a long shape accordingly.

The full line-type print head as described above also has a number of heaters for ejecting ink. This causes a tendency where the ink in a common liquid chamber is heated by a heater to have a high temperature. To prevent this, a technique has been known in which the space in a common liquid chamber of a print head and a sub tank for storing ink supplied to the common liquid chamber are used as a circulation passage so that a pump provided to the passage is used to circulate ink, thus allowing the ink in the sub tank to be circulated in the common liquid chamber. Such a circulation of ink prevents the ink from having a high temperature to suppress the temperature increase of the print head.

The operation for circulating ink as described above also has, in addition to the purpose for suppressing the temperature increase of ink, another purpose for exhausting bubbles accumulated in the common liquid chamber to outside, for example.

FIG. 9 is a cross-sectional view schematically showing a supplying ink circulation system disclosed in Japanese Patent Application Laid-Open No. 11-179932 (1999).

As shown in FIG. 9, the supplying ink circulation system 150 has the ink jet head 101, the subtank 103 temporally storing ink to be supplied to the ink jet head 101, and the main tank 102 for storing ink. The supplying ink circulation system 150 is used by being provided to an ink jet printer (not shown).

The ink jet head 101 includes a plurality of ejection ports 101*a* for ejecting ink, and one common liquid chamber 126 for storing ink to be supplied to the respective ejection ports 101*a*. At a position at which the ink jet head 101 is opposed to a port opening surface, the cap 108 is provided for receiving ink pushed out of the ejection port 101*a*.

The subtank 103 includes the first tank 103*a* and the second tank 103*b*. The first and second tanks 103*a* and 103*b* are divided to have an enclosed space, respectively. The first tank 103*a* and the second tank 103*b* store ink while including therein a predetermined amount of air buffer. The existence of air buffer left in this manner absorbs the fluctuation of the flow rate of ink caused when the ink is circulated.

The first tank 103*a* has, at the upper face thereof, the air communication passage 134 for communicating air in the tank. The air communication passage 134 is attached with the air communication valve 106*d* for opening or closing this communication passage.

The main tank 102 has an ink cartridge-like shape so that the main tank 102 can be exchanged with a new one in an ink jet printer (not shown) and stores therein ink having a predetermined color.

The respective components as described above are appropriately connected by tube members. As a result, the ink jet printer can be operated with "ink supply mode", "ink circulation mode", "ink eject mode" or the like. Among these operations, the "ink circulation mode" will be described with regards to the configuration and operation.

In order to circulate ink in the common liquid chamber 126, the common liquid chamber 126 has, at the upstream side and the downstream side, the first passage 132 and the second passage 133 communicated to each other, respectively.

The other end of the first passage 132 is communicated with the second tank 103*b* of the subtank 103 while the other end of the second passage 133 is communicated with the first tank 103*a*. The first and second tanks 103*a* and 103*b* are communicated to each other by a tube member. As described above, the supplying ink circulation system 150 has one circulation passage by the first passage 132, the second passage 133, and the tube member for communicating the first tank 103*a* to the second tank 103*b*.

The tube member for communicating the first tank 103*a* to the second tank 103*b* has, at the intermediate position thereof, the first pump 104 for moving ink in the first tank 103*a* into the second tank 103*b*. This first pump 104 is used to circulate ink.

The cap 108 is communicated with the collection passage 135 for collecting ink received by the cap 108. The other end of the collection passage 135 is communicated with the space in the first tank 103*a* of the subtank 103. The collection passage 135 includes the filter 152 for capturing foreign matters in ink and the second pump 109 for sucking ink from the cap 108.

The supplying ink circulation system 150 structured as described above is driven with the "ink circulation mode" as described below.

When the first pump 104 is driven while the air communication valve 106*d* being closed, ink in the first tank 103*a* is flowed into the second tank 103*b*. As a result, the ink in the second tank 103*b* is pressurized and is flowed via the first passage 132 to the common liquid chamber 126 (see the direction shown by the arrow in the drawing). In accordance with this, ink in the common liquid chamber 126 is partially pushed out into the second passage 133 and is returned to the first tank 103*a* via the second passage 133. The ink left in the common liquid chamber 126 is partially pushed out of the ejection port 101*a* and is received by the cap 108.

Then, the second pump 109 is driven in synchronization with the first pump 104 so that the ink received by the cap 108 is returned via the collection passage 135 to the first tank 103*a*.

The following section will describe in detail the circulation operation as described above.

First, immediately after the start of the circulation operation, the first pump 104 is driven to flow ink into the second tank 103*b* and the space in the second tank 103*b* is pressurized while the air buffer therein being compressed. The pressurization of the second tank 103*b* in this manner pushes the ink in the tank toward the common liquid chamber 126. On the other hand, ink in the first tank 103*a* is sucked toward the second tank 103*b* and thus the tank has therein a negative pressure to inflate the air buffer. In the situation immediately after the start of the circulation operation as described above, the pressures in subtank 103 and in the common liquid chamber 126 are not stabilized yet and thus a relatively large amount of ink is pushed out of the ejection port 101*a*. When a filter (not shown) for cleaning ink is provided at the side of the second passage 133 in FIG. 9 in particular, a larger amount of ink is pushed out because the space in the common liquid chamber 126 tends to be pressurized due to the influence by the pressure loss of this filter.

When a certain period of time has passed since the start of the circulation operation, the pressures in the subtank 103 and in the common liquid chamber 126 are stabilized. Specifically, the inflation or contraction of the air buffer is stopped and the amount of ink pushed out of the ejection port 101*a* is also reduced, thus causing the amount of ink flowing into the subtank 103 to be the same as that of ink flowing in the first pump 104.

However, the circulation system as described above causes the subtank to be closed while the common liquid chamber being communicated with air via the ejection port even when the circulation operation is performed in the stabilized condition, thus causing the differential pressure between the common liquid chamber and the subtank. Due to this reason, the ink circulation operation may not be stopped in some cases, even when the pump is stopped. As a result, the common liquid chamber has therein a negative pressure. This has caused a case in which the negative pressure having a magnitude that exceeds an ink meniscus retention force in the ejection port causes air to be sucked via the ejection port. When the air sucked via the ejection port is collected as bubbles in the common liquid chamber, the ejection may not be provided to a correct manner.

The air suction phenomenon as described above tends to be caused as the pump has a larger flow rate or as the air buffer in the subtank has a larger capacity. The air suction phenomenon also tends to be caused when the exhaust side of the common liquid chamber has a filter and the filter has a larger pressure coefficient. Specifically, the prevention of the air suction as described above is desirable because it improves the freedom in the selection of a pump or a filter or the freedom in the selection of the setting of an air buffer.

The ink circulation operation may have, in addition to a defect caused by the air suction as described above, a defect in which the space in the common liquid chamber is pressurized immediately after the start of the circulation operation to cause the ink to be pushed out of the ejection port. The ink pushed out as described above is not particularly problematic in the configuration as shown in FIG. 9 in which the pushed-out ink is again returned to the subtank 103. However, the pushed-out ink is a problem in a configuration in which the pushed-out ink is collected by an independent waste ink collection tank.

SUMMARY OF THE INVENTION

It is an object of the present invention to provide a liquid ejection apparatus and a liquid processing method by which a circulation operation of liquid (e.g., ink) is prevented from causing air to be sucked via an ejection port or causing, on the contrary, liquid from being pushed out of an ejection port.

The first aspect of the present invention that can achieve the above objects is a liquid ejection apparatus, the liquid ejection apparatus comprises a head for ejecting liquid from an ejection port, a subtank for temporally storing liquid to be supplied to the liquid ejecting head, an air communication valve for opening or closing a passage for communicating air in the subtank, a circulation flow line for providing communication between the liquid ejecting head and the subtank for circulation, pumping means that is provided to this circulation flow line for circulating liquid between the liquid ejecting head and the subtank, and means for controlling the air communication valve and the pumping means to circulate liquid by closing the air communication valve while driving the pumping means and for opening, simultaneously with or immediately after the stoppage of the pumping means, the air communication valve to communicate air in the subtank.

In the liquid ejection apparatus according to the present invention, when the pumping means is energized to stop the circulation operation for circulating the liquid between the liquid ejecting head and the subtank, the controlling means opens, simultaneously with or immediately after the stoppage of the pumping means, the air communication valve to recover the negative pressure in the subtank within a short period of time, thereby eliminating the differential pressure between the subtank and the liquid ejecting head within a short period of time.

According to the liquid ejection apparatus of the present invention, the liquid ejection apparatus comprises the controlling means for communicating, when the circulation operation is stopped, air in the subtank simultaneously with or immediately after the stoppage of the pumping means. Thus, the differential pressure between the subtank and the liquid ejecting head is eliminated within a short period of time. This can suppress air from being sucked by the ejection port, thus improving the reliability of the liquid ejection apparatus.

In the liquid ejection apparatus according to the first aspect of the present invention, the circulation flow line may include a first passage for supplying liquid from the subtank into the liquid ejecting head, and a second passage for returning liquid from the liquid ejecting head into the subtank, and the liquid ejection apparatus further may comprise a switching valve that is provided to the second passage for opening or closing this second passage.

The liquid ejection apparatus may further comprise a main tank for storing liquid to be supplied to the subtank, a passage for supplying the liquid in this main tank into the subtank, and means for detecting the remaining amount of the ink in the subtank to output the amount to the controlling means, when the remaining amount of the liquid in the subtank detected by the detecting means is equal to or lower than a predetermined value, then the controlling means opens the air communication valve while liquid in the main tank is being supplied into the subtank.

Furthermore, when liquid in the main tank is supplied into the subtank, the liquid is preferably filled up in the subtank. The expression "liquid is filled up in the subtank" means a status in which a sensor for detecting the amount of the liquid in the subtank detects that the liquid is filled up. Thus, this expression includes a status in which the subtank is filled with liquid while including a predetermined amount of air buffer.

In the present invention, the liquid ejection apparatus preferably has a merging portion at which the supplying passage merges into the first passage and the pumping means is provided to the first passage between this merging portion and the subtank so that liquid can be flowed in both directions. Furthermore, the liquid ejection apparatus also may further comprise a valve for switching between a first status in which the communication between the subtank and the main tank is blocked to provide the communication between the subtank and the ink ejecting head and a second status in which the communication between the subtank and the ink ejecting head is blocked to provide the communication between the subtank and the main tank. The controlling means also may operate the switching valve to provide the communication between the subtank and the main tank, thereby supplying ink in the main tank into the subtank.

The second aspect of the present invention is a liquid processing method in a liquid ejection apparatus including a head for ejecting liquid from an ejection port, a subtank for temporally storing liquid to be supplied to the liquid ejecting head, an air communication valve for opening or closing a passage for communicating air in the subtank, and a circulation flow line for providing communication between the liquid ejecting head and the subtank for circulation, the liquid processing method comprises the steps of circulating liquid while the air communication passage is being closed, and opening, simultaneously with or immediately after the completion of the liquid circulation, the air communication passage to communicate air in the subtank.

In the liquid processing method according to the second aspect of the present invention, the liquid ejection apparatus further includes a main tank for storing liquid to be supplied to the subtank and a passage for supplying liquid in this main tank into the subtank, the liquid processing method further comprises, prior to the step for circulating liquid, a step of detecting the remaining amount of liquid in the subtank, and a step of supplying, when the remaining amount of liquid in the subtank is equal to or lower than a predetermined value, the liquid in the main tank into the subtank while the air communication valve is being opened. In this case, the liquid processing method may further comprise, prior to the step for supplying the liquid in the main tank into the subtank, a step of blocking the communication between the subtank and the liquid ejecting head while providing the communication between the subtank and the main tank.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, embodiments of the present invention will be described with reference to the drawings.

Embodiment 1

—Structure of Supplying Ink Circulation System—

Figure 1:
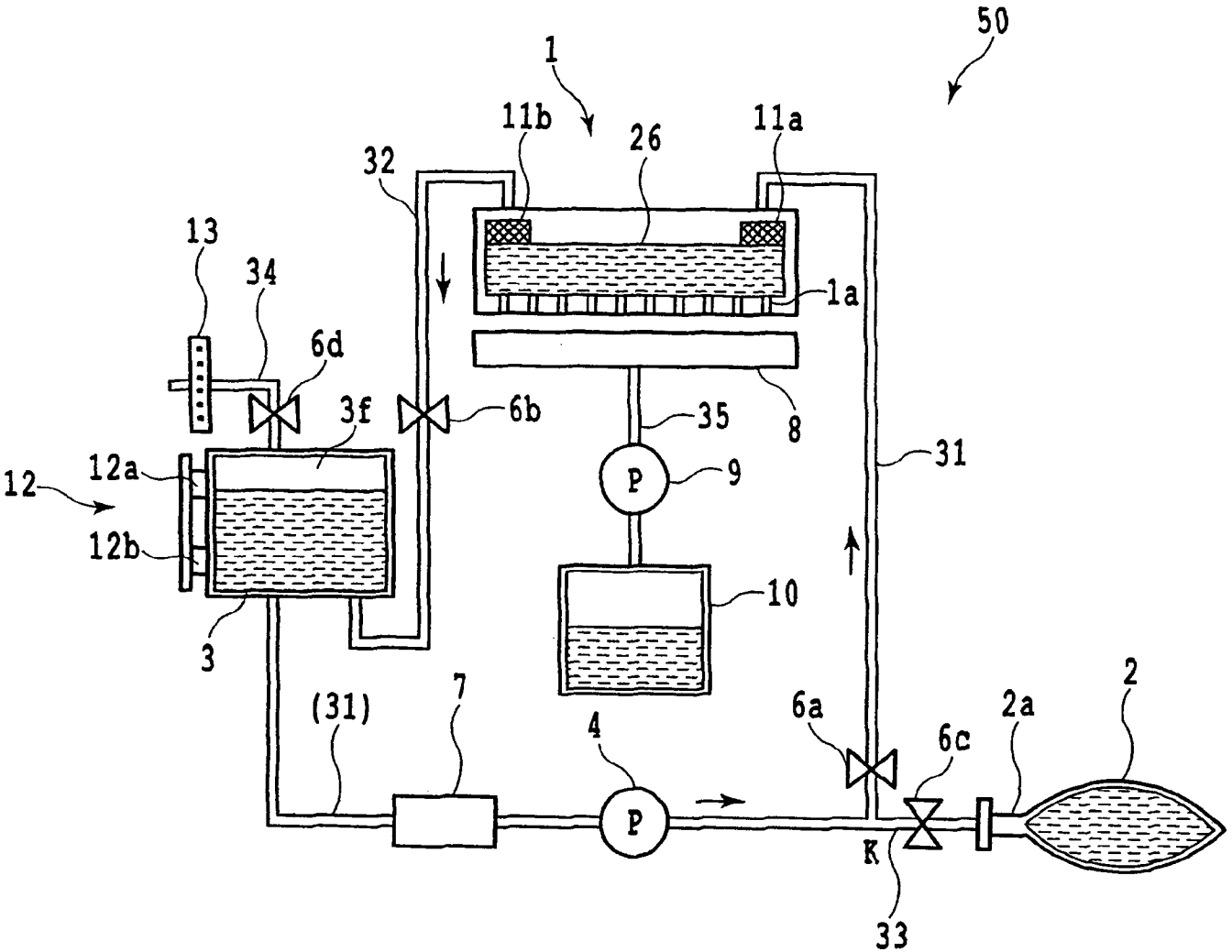
FIG. 1 is a cross-sectional view showing the structure of a supplying ink circulation system according to one embodiment of the present invention.

FIG. 1 is a cross-sectional view schematically showing the structure of a supplying ink circulation system according to one embodiment of the present invention.

As shown in FIG. 1, the supplying ink circulation system 50 has the full line-type ink jet head 1, the main tank 2 for storing ink supplied to the ink jet head 1, and the subtank 3 that is provided between the ink tank 2 and the ink jet head 1 and that temporally stores ink supplied from the main tank 2. The supplying ink circulation system 50 is used by being provided to an ink jet printer (not shown). The supplying ink circulation system 50 also includes, in an independent manner, the waste ink collection tank 10 for storing ink (waste ink) pushed out of the ink jet head 1.

The supplying ink circulation system 50 mainly has two passages (which will be described later). One of the passages is a circulation passage for the circulation among the ink jet head 1, the main tank 2, and the subtank 3. The other of the passages is a collection passage in which ink pushed out of the ink jet head 1 is received by the cap 8 and is collected in the waste ink collection tank 10.

The ink jet head 1 has a plurality of ejection ports 1*a* for ejecting ink, and one common liquid chamber 26 for storing ink supplied to the respective ejection ports 1*a*. A printing operation is performed by causing ink supplied from the main tank 2 via the subtank 3 to the common liquid chamber 26 to be ejected from the ejection port 1*a*.

The main tank 2 is a flexible ink bag for storing ink that can be exchanged in the supplying ink circulation system 50. The main tank 2 partially has a supply port (not shown) for supplying ink to the exterior that is provided by an elastic member (e.g., rubber). This supply opening is inserted with the ink communication needle 2*a* so that the main tank 2 is connected to the supplying ink circulation system 50.

The subtank 3 is configured as an airtight container that stores ink while including therein a predetermined amount of air buffer 3*f*. The upper face of the subtank 3 is connected with the air communication passage 34 for communicating air to the interior of the subtank 3. The air communication passage 34 is attached with the air filter 13 for preventing dust from intruding into the subtank 3 and the air communication valve 6*d* for opening or closing the air communication passage 34. The air communication valve 6*d* is the same as other switching valves 6*a* to 6*c* (which will be described later) and the details will be described later.

Figure 2:
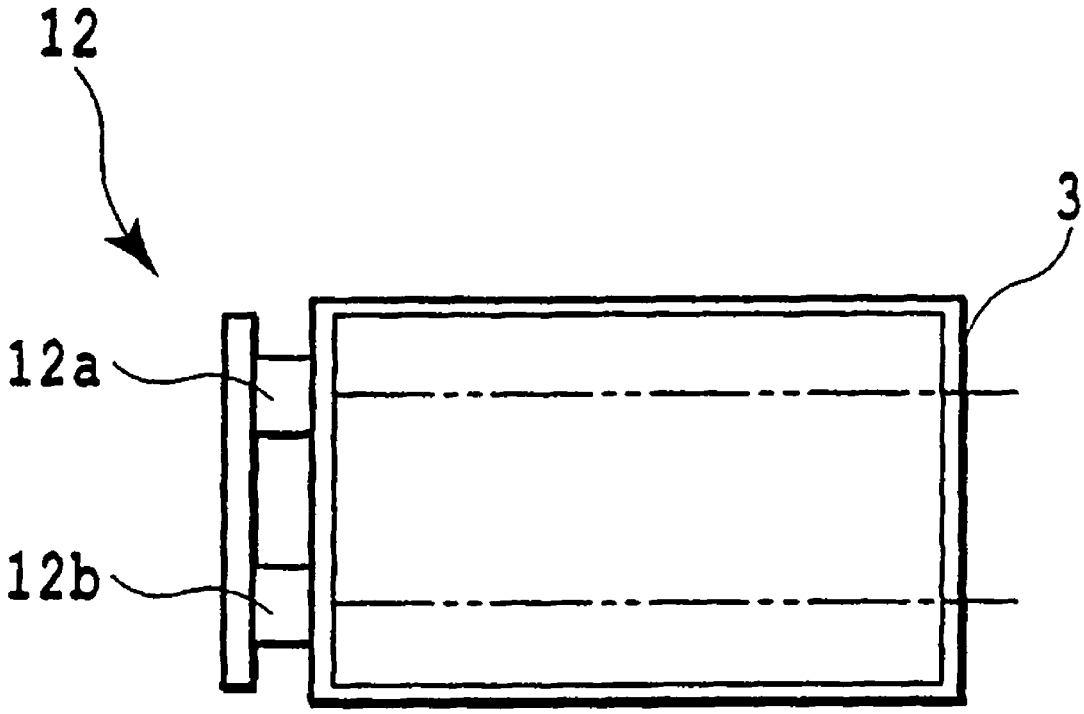
FIG. 2 illustrates a section for detecting the ink remaining amount in a subtank.

The subtank 3 has, at the side face thereof, the detecting section 12 for detecting the remaining amount of ink in the subtank 3. The detecting section 12 includes, as shown in FIG. 2, the fill-up detection sensor 12*a* for detecting when the ink in the subtank 3 is filled up and the empty detection sensor 12*b* for detecting when the ink in the tank is used up. Any of the sensors 12*a* and 12*b* may be an optical sensor provided with LED, optical prism, and photosensor or the like. The term "fill-up" does not mean that the subtank 3 is filled with ink perfectly but means that the subtank 3 is filled with ink while including therein a predetermined amount of air buffer 3*f* (see FIG. 1). The position at which the fill-up detection sensor 12*a* is attached is adjusted so that the fill-up can be detected while allowing the subtank 3 to have therein a predetermined amount of air as described above.

With reference to FIG. 1 again, the ink passage of the supplying ink circulation system 50 will be described.

As shown in FIG. 1, the ink jet head 1 is connected to the subtank 3 by a pair of tube members to form a circulation passage. One of the pair of tube members is the first passage 31 for supplying ink in the subtank 3, via the filter 11*a*, into the common liquid chamber 26 of the ink jet head 1. The other of the pair of tube members is the second passage 32 for returning the ink pushed out of the common liquid chamber 26, via the filter 11*b*, into the subtank. The first passage 31 and the second passage 32 are connected to the connecting portions of the common liquid chamber 26. The connecting portions include the filters 11*a* and 11*b* for capturing foreign matters in the ink as described above. The filters 11*a* and 11*b* arranged as described above prevent foreign matter from intruding into the common liquid chamber 26.

The passage 33 is used for supplying ink in the main tank 2 into the subtank 3. The supplying passage 33 merges at the merging portion K at the intermediate position of the first passage 31. In FIG. 1, a passage from this merging portion K to the subtank 3 is shown as the first passage 31. The passage 31 between the above merging portion K in the first passage 31 and the subtank 3 is structured so as to be also used as a passage for supplying, by the action by the main pump 4 that can be driven in a reverse direction, ink in the main tank 2 into the subtank 3. In this way, the passage from the ink jet head 1 is merged into the passage from the main tank 2, thereby providing a simplified passage.

The first passage 31 includes the main pump 4 that can be operated in forward and backward directions so as to flow the ink in two directions, and the flowmeter 7 for measuring the flow rate of the moving ink.

The respective passages 31 to 33 include three switching valves 6*a* to 6*c* for opening or closing these passages 31 to 33. The first switching valve 6*a* is provided to the first passage 31, the second switching valve 6*b* is provided to the second passage 32, and the supply switching valve 6*c* is provided to the supplying passage 33. The supply switching valve 6*c* and the first switching valve 6*a* constitute a switching valve of the present invention. More particularly, the first switching valve 6*a* is in the vicinity of the merging portion K at which the supplying passage 33 is merged into the first passage 31 so as to be provided at the intermediate position between this merging portion and the ink jet head 1.

The respective switching valves 6*a* to 6*c* are controlled in an independent manner and are opened or closed with different manners to change the communication status between ink passages. For example, when the supply switching valve 6*c* is closed and the first switching valve 6*a* is opened, the subtank 3 is communicated with the ink jet head 1, thus allowing the ink in the subtank 3 to be flowed into the ink jet head 1. On the contrary, when the supply switching valve 6*c* is opened and the first switching valve 6*a* is closed, the main tank 2 is communicated with the subtank 3, thus allowing the ink in the main tank 2 to be flowed into the subtank 3.

The respective switching valves 6*a* to 6*c* and the above-described air communication valve 6*d* have the same structure and also may be provided, for example, as a solenoid on-off valve by providing a solenoid plunger with a sealing function. Although the respective switching valves 6*a* to 6*d* including the air communication valve 6*d* may have an initial status that is not particularly limited, the switching valves 6*a* to 6*c* and the air communication valve 6*d* in this embodiment as shown in the drawing have initial statuses in which the switching valve 6*a* is opened, the switching valve 6*b* is opened, the switching valve 6*c* is closed, and the air communication valve 6*d* is opened, respectively and, when a control signal is inputted, the switching valve 6*a* is closed, the switching valve 6*b* is closed, the switching valve 6*c* is opened, and the air communication valve 6*d* is closed, respectively.

The cap 8 provided to be opposed to the ink jet head 1, the waste ink collection tank 10 for storing waste ink, the waste ink passage 35 for providing the communication between the cap 8 and the waste ink collection tank 10, and the subpump 9 provided to the waste ink passage 35 are provided to the collection passage for collecting waste ink. In the collection passage structured as described above, the subpump 9 is driven to allow the ink received by the cap 8 to be collected via the waste ink passage 35 into the waste ink collection tank 10. This collecting operation can be carried out by a known control method and thus the details will not be described.

The above main pump 4 and the subpump 9 may be a tube pump or may be a cylinder pump. Although the configuration shown in FIG. 1 was provided such that the first passage 31 and the supplying passage 33 include two switching valves of the first switching valve 6*a* and the supply switching valve 6*c*, respectively, the present invention is not limited to the configuration in which two switching valves are provided. Another configuration also may be used in which one switching valve is provided by which a status in which the communication between the subtank 3 and the main tank 2 is blocked to provide the communication between the subtank 3 and the ink jet head 1 can be switched with a status in which the communication between the subtank 3 and the ink jet head 1 is blocked to provide the communication between the subtank 4 and the main tank 2.

Figure 3:
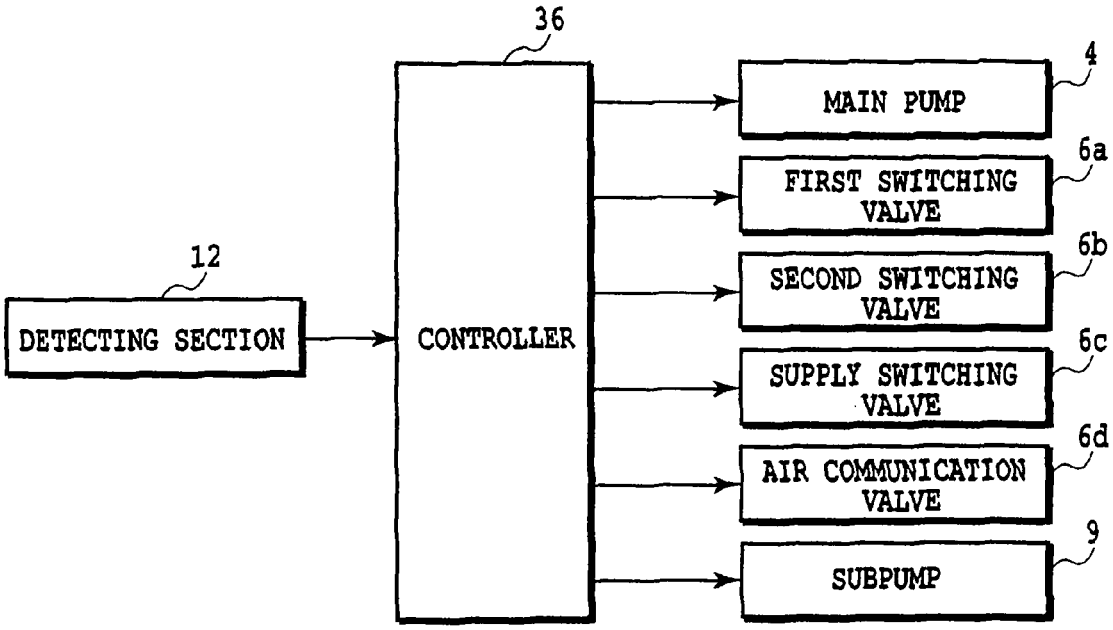
FIG. 3 is a block diagram of the control of the supplying ink circulation system shown in FIG. 1.

A control block diagram in this embodiment is shown in FIG. 3. Specifically, a signal detected by the detecting section 12 is outputted to the controller 36. Then, the controller 36 controls, in accordance with a predetermined program, the above-described main pump 4, the switching valves 6*a* to 6*c*, the air communication valve 6*d*, and the subpump 9 for example.

The supplying ink circulation system 50 of this embodiment structured as described above is controlled by the controller 36 in accordance with various operating modes of an ink jet printer (not shown). Such operating modes include, for example, an "ink supply mode" for supplying ink into the subtank 3, a "pressurization recovery mode" for forcedly pushing ink out of the ejection port 1*a*, a "print mode" for ejecting ink from the ejection port 1*a* for printing, and a "circulation mode" for circulating ink in the common liquid chamber 26 that is a characteristic part of the present invention. The respective modes will be described.

—Ink Supply Mode—

The "ink supply mode" is a mode for supplying ink in the main tank 2 into subtank 3. For example, the ink supply mode is performed in an initial status of an ink jet printer (not shown) in which the subtank 3 stores no ink.

In the ink supply mode, the first switching valve 6*a* is closed and the supply switching valve 6*c* is opened to provide the communication between the subtank 3 and the main tank 2 while the main pump 4 being energized in the forward direction, thereby supplying ink into the subtank 3. The ink supply mode may be separately performed or also may be performed while ink is being ejected from the ink jet head 1 (i.e., while the print mode is being performed). Thus, opening or closing of the second switching valve 6*b* are appropriately determined depending on the operating mode.

Figure 4:
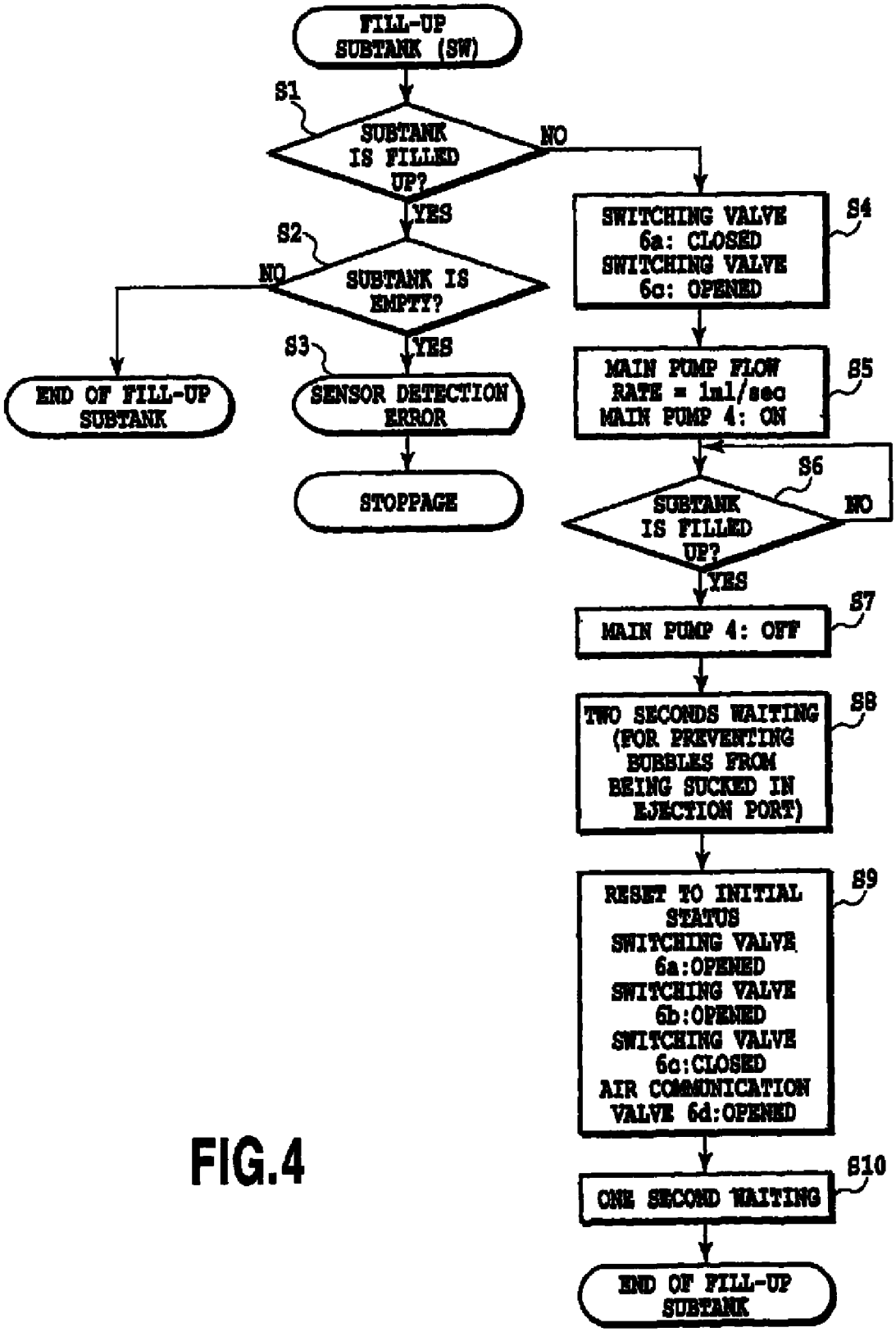
FIG. 4 shows a flowchart of an ink supply mode.

A specific driving of the ink supply mode will be described with reference to the flowchart of FIG. 4.

First, the detecting section 12 is driven to detect the remaining amount of ink in the subtank 3 (Step S1).

Then, when the fill-up detection sensor 12*a* detects that ink is filled up, then the empty detection sensor 12*b* detects whether the subtank 3 is empty or not (Step S2). When the empty detection sensor 12*b* detects that the subtank 3 is not empty, it means that the ink is filled up in the subtank 3 and thus there is no need to supply ink, thus completing the set of steps of ink supply modes. On the other hand, when the empty detection sensor 12*b* detects that the subtank 3 is empty, then this detection result is inconsistent with the detection result by the fill-up detection sensor 12, showing a possibility where any or both of the sensors 12*a* and 12*b* may have a failure. In this case, a user is notified that the detecting section 12 has an abnormality (Step S3). Then, the ink supply mode is completed.

When Step S1 shows that the fill-up detection sensor 12*a* detects that ink is not filled up, then ink is supplied from the main tank 2 into the subtank 3 by the procedure as described below. First, the first switching valve 6*a* is closed and the supply switching valve 6*c* is opened as described above to provide the communication between the subtank 3 and the main tank 2 via the supplying passage 33 and the first passage 31 (Step S4).

Next, the main pump 4 is driven in the forward direction to supply ink in the main tank 2 into the subtank 3 via the switching valve 6*c*, the pump 4, and the first passage 31 (Step S5). The main pump 4 may have a flow rate of 1 ml/sec., for example. While the main pump 4 is being driven, pressure loss by the ink communication needle 2*a* inserted to the main tank 2 causes a negative pressure in the supplying passage 33 and the first passage 31 between the main tank 2 and the main pump 4.

The main pump 4 is driven until ink is filled up in the subtank 3. Specifically, in order to generate a timing at which the main pump 4 is stopped, the detecting section 12 is driven to detect the amount of ink in the subtank 3 while the main pump 4 is being driven (Step S6).

Next, when ink is filled up in the subtank 3, the main pump 4 is stopped (Step S7). At this point of time, the supplying passage 33 has therein a negative pressure as described above. This may cause a possibility where, when the first switching valve 6*a* is opened immediately after the stoppage of the main pump 4, a negative pressure is also caused via the first passage 31 in the common liquid chamber 26 of the ink jet head 1, thus causing the ejection port 1*a* to suck air. To prevent this, this embodiment provides Step S8 for providing, after the stoppage of the main pump 4 (Step S7), a predetermined time (e.g., 2 seconds) for recovering a pressure in the supplying passage 33 to an atmospheric pressure.

Next, the respective switching valves 6*a* to 6*d* are provided to have an initial status (Step S9) and to subsequently wait for a predetermined time (Step S10). Thereafter, the set of steps of the ink supply mode are completed.

—Pressurization Recovery Mode—

The "pressurization recovery mode" is a mode for pressurizing the space in the common liquid chamber 26 of the ink jet head 1 to eject ink in the ejection port 1*a* in a forced manner. Such a forced ejection of ink is performed for the purpose of pushing out ink having an increased viscosity or for pushing out bubbles mixed in ink.

The "ink having an increased viscosity" is caused, for example, when a print operation is repeated for a long time to increase the temperature of ink in the ejection port 1*a* to cause the moisture in the ink to evaporate from the ejection port 1*a*. When the ink having an increased viscosity as described above is left in the ejection port 1*a*, the ejection port 1*a* is sealed by the ink, which may cause a failure in the ejection. The "bubbles mixed in the ink" are caused, for example, when the common liquid chamber 26 has therein a negative pressure to cause air to be sucked into the ejection port 1*a* and is also caused when small bubbles dissolved in the ink are united. Any of the ink having an increased viscosity or the mixed bubbles as described above causes a failure in the ejection. In order to prevent them, the ink having an increased viscosity or mixed bubble must be pushed out.

In the pressurization recovery mode, the first switching valve 6*a* is opened, the second switching valve 6*b* is closed, the supply switching valve 6*c* is closed, and the air communication valve 6*d* is opened to provide the communication between the subtank 3 and the ink jet head 1 via the first passage 31 while the main pump 4 is being driven, thereby supplying ink in the subtank 3 into the ink jet head 1 via the first passage 31, the switching valve 6*a*, the first passage 31, the filter 11*a*, and the common liquid chamber 26 to eject ink from the ejection port 1*a* in a forced manner.

Figure 5:
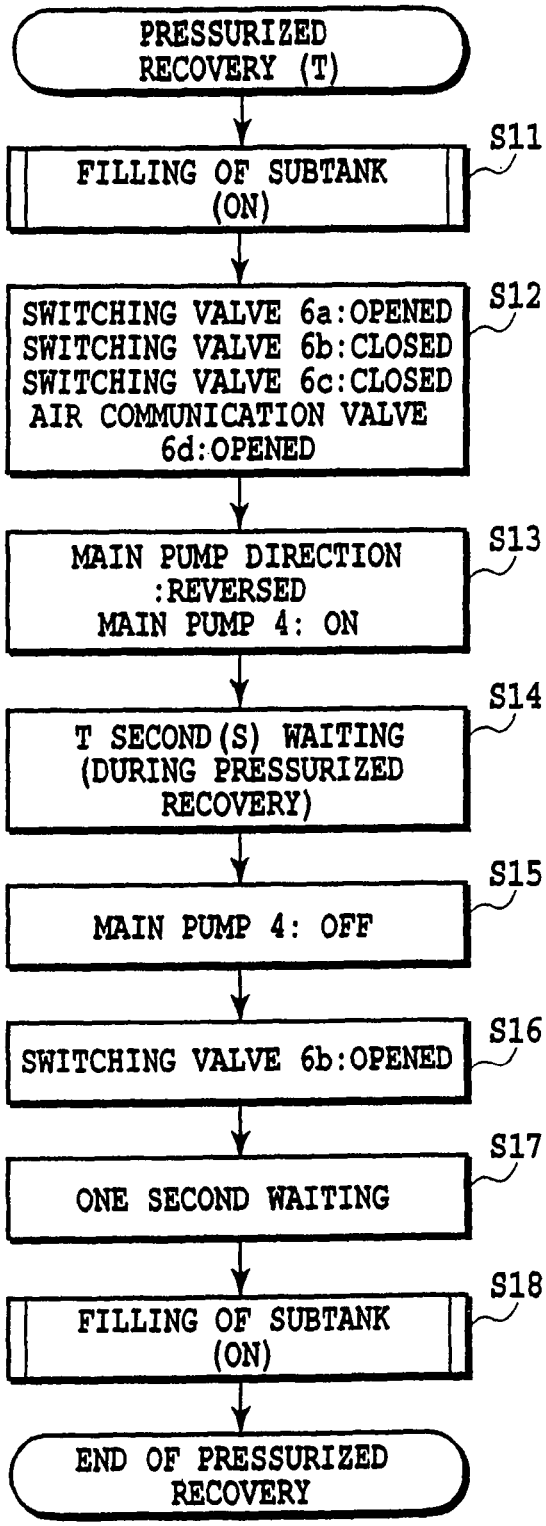
FIG. 5 shows a flowchart of a pressurization recovery mode.

A specific driving in the pressurization recovery mode will be described with reference to the flowchart of FIG. 5.

First, the above-described ink supply mode (see FIG. 4) is performed so that ink is filled up in the subtank 3 (Step S11). Next, the switching valve 6*a* is opened, the switching valve 6*b* is closed, the switching valve 6*c* is closed, and the air communication valve 6*d* is opened, respectively (Step S12). This provides the communication between the subtank 3 and the ink jet head 1 to close the second passage 32. The air communication passage 34 is opened.

Next, the main pump 4 is driven in a backward direction (Step S13) to continue this driving status for a predetermined time (e.g., T seconds) (Step S14). This will be described with reference to FIG. 1. The ink in the subtank 3 is supplied from the subtank 3 into the common liquid chamber 26 via the first passage 31, the switching valve 6*a*, and the first passage 31. More specifically, the ink in the subtank 3 is supplied by the action by the main pump 4 via the first passage 31 into the common liquid chamber 26. In accordance with this, the ink in the common liquid chamber 26 is pressurized so that the ink having the same amount as that of the supplied ink is pushed out from the ejection port 1*a*. At this point, the subtank 3 is being communicated with air as described above and thus the subtank 3 sucks outside air as ink is being supplied into the common liquid chamber 26, thereby providing ink supply in a smoother manner.

By the forced ejection of ink as described above, the bubbles mixed in the ink in the common liquid chamber 26 or the ink having an increased viscosity in the ejection port 1*a* is pushed out to outside, thereby recovering the function of the ink jet head 1.

Next, the main pump 4 is stopped (Step S15), thus completing the forced ejection of ink. Thereafter, the second switching valve 6*b* is provided to have an initial status (open) (Step 16).

When the main pump 4 is being driven in the pressurization recovery mode, the action by the main pump 4 causes a differential pressure between the ink jet head 1 and the subtank 3 (specifically, the common liquid chamber 26 is being pressurized). To prevent this, this embodiment provides Step S17 for waiting for a predetermined time (e.g., 1 second) in order to eliminate the differential pressure between the ink jet head 1 and the subtank 3 so that this differential pressure is provided to have an initial status (status in which the differential pressure equals to a water head differential pressure).

Next, the ink supply mode (see FIG. 4) is performed in which ink having an amount that is the same as that supplied into the common liquid chamber 26 is supplied from the main tank 2 into the subtank 3 (Step S18), thereby completing the set of steps of the pressurization recovery mode. An amount of ink in this mode is measured by the flowmeter 7.

—Print Mode—

The "print mode" is a mode in which the second switching valve 6*b* is opened without driving the main pump 4 to provide the communication between the subtank 3 and the common liquid chamber 26 while ejecting ink from the ejection port 1*a* of the ink jet head 1 for printing. When ink is ejected from the ejection port 1*a*, ink having the same amount as that of the ejected ink is sucked by a capillary force from the subtank 3 into the common liquid chamber 26.

Figure 6:
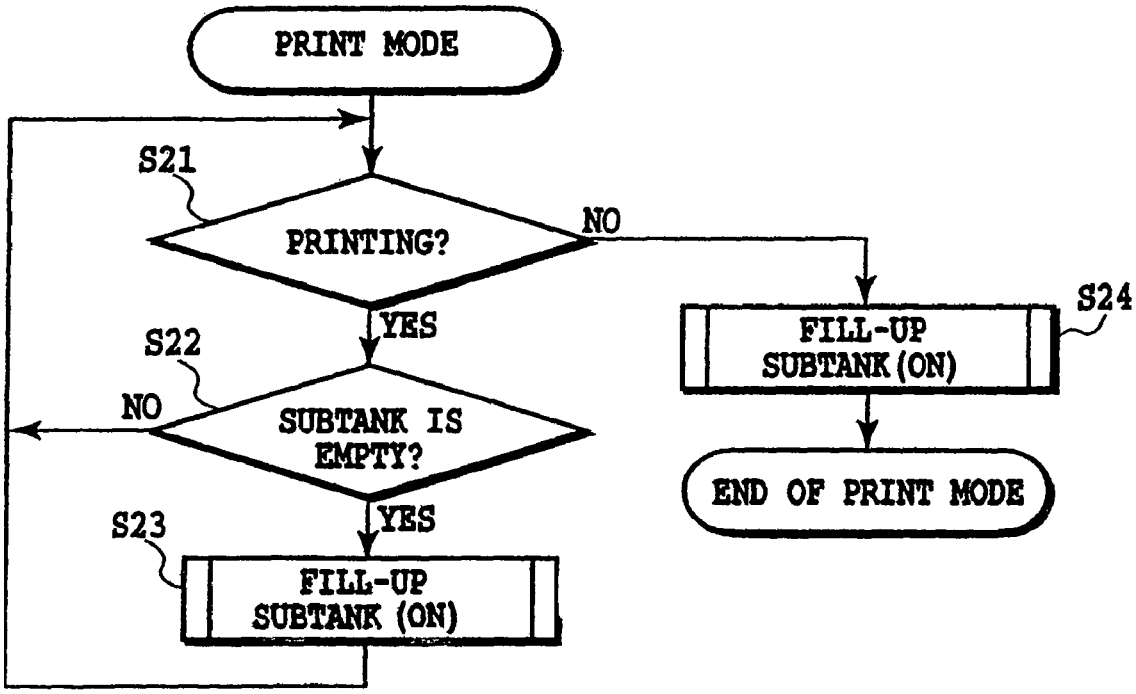
FIG. 6 shows a flowchart of a print mode.

A specific driving of the print mode will be described with reference to the flowchart of FIG. 6.

First, the first switching valve 6*a* is opened, the second switching valve 6*b* is opened, the supply switching valve 6*c* is closed, and the air communication valve 6*d* is opened to provide the communication between the subtank 3 and the common liquid chamber 26 while providing air communication to the subtank 3. Then, ink in this status is ejected from the ejection port 1*a* to perform a printing (Step S21). In this status, the port opening surface of the ink jet head 1 is opposed to a printing medium.

While ink is being ejected from the ink jet head 1, the detecting section 12 is driven to detect the remaining amount of ink in the subtank 3 (Step S22).

When the amount of ink in the subtank 3 is sufficient, the print operation of Step S21 is continued. On the other hand, when it is detected that the subtank 2 is empty, the printing operation of Step S21 is continued while the ink supply mode (see FIG. 4) is being performed to supply ink from the main tank 2 into the subtank 3 (Step S23) during which the second switching valve 6*b* is being opened.

When Step S21 judges that the print operation is finished, ink is supplied as required into the subtank 3 (Step S24), thus completing the set of steps of the print mode.

—Circulation Mode—

The "circulation mode" is a mode performed for the purpose of cooling the ink jet head 1 having a high temperature by the print operation or for exhausting bubbles to the exterior that are not dissolved in ink in the common liquid chamber 26 and are collected, as described above.

In the circulation mode, the first switching valve 6*a* is opened, the second switching valve 6*b* is opened, the supply switching valve 6*c* is closed, and the air communication valve 6*d* is closed to allow the subtank 3 and the ink jet head 1 to provide one circulation passage while the main pump 4 is being driven in the backward direction, thereby circulating the ink in the subtank 3 into the common liquid chamber 26 via the first passage 31, the switching valve 6*a*, the first passage 31, the filter 11*a*, the common liquid chamber 26, the filter 11*b*, the second passage 32, and the switching valve 6*b*.

A specific driving in the circulation mode will be described with reference to the flowchart of FIG. 7.

First, in order to provide the air buffer 3*f* in the subtank 3 having a predetermined amount, the above-descried ink supply mode (see FIG. 4) is performed so that ink is filled up in the subtank 3 (Step S31).

Next, in order to prevent the subtank 3 during the circulation from sucking outside air, the air communication valve 6*d* is closed (Step S32). In this status, the switching valve 6*a* is opened, the switching valve 6*b* is opened, and the switching valve 6*c* is closed, respectively.

Next, the main pump 4 is driven in the backward direction (Step S33) simultaneously with the driving of a timer (not shown) for measuring the time of the circulation operation (Step S34). When the main pump 4 is driven, the ink has a circulating flow to cause ink to be supplied, as shown by the arrow in the drawing, from the filter 11*a* into the common liquid chamber 26. Then, the ink is circulated via the second passage 32 toward the subtank 3. The main pump 4 in this status may have a flow rate of 2 ml/sec., for example.

When the main pump 4 is driven, the filter 11*a* side of the ink jet head 1 (upstream side of the circulating flow) is directly transmitted with the action by the pump while the filter 11*b* side of the ink jet head 1 (downstream side of the circulating flow) is not directly transmitted, due to the action by the air buffer 3*f*, with the action by the pump. Specifically, the action by the pump causes the subtank 3 immediately after the driving of the main pump to have therein a negative pressure. A part of this negative pressure is used for inflating the air buffer 3*f* and thus this buffering action prevents the filter 11*b* side from being directly transmitted with the action by the pump. As a result, the common liquid chamber 26 has such an ink input/output balance in which an excessive amount of ink is inputted into the common liquid chamber 26, thus allowing the ejection port 1*a* immediately after the driving of the pump to push out ink in a relatively easy manner. In order to minimize this, the amount of the air buffer 3*f* and the flow rate of the circulating flow may be reduced.

When a certain period of time has passed since the driving of the main pump 4, the inflation of the air buffer 3*f* is stopped. As a result, ink flowed out of the common liquid chamber 26 has the same flow rate as that in the main pump 4 and the ink in the common liquid chamber 26 is communicated with air via the ejection port 1*a* and the pressure thereof is gradually close to the atmospheric pressure. Thus, the amount of ink pushed out of the ejection port 1*a* is also gradually reduced.

The driving of the main pump 4 is performed for "T" second(s). This duration for "T" second(s) is judged by Step S35 based on the time "t" measured by the above timer. When Step S35 judges that the duration for "T" second(s) has passed, then the main pump 4 is stopped (Step S37).

There is a case in which, even when the duration for "T" second(s) is not yet reached in the circulation operation, a user cancels the instruction for the circulation operation. Thus, Step S36 is provided as a step for judging this instruction for stoppage. Specifically, when the user inputs the instruction for stoppage even when the duration for "T" second(s) is not yet reached in the circulation operation, then the instruction is judged by Step S36 and the main pump 4 is stopped (Step S37).

Next, in order to recover the subtank 3 having a negative pressure, the air communication valve 6*d* is opened (Step S38). Step S38 is performed immediately after the stoppage of the main pump 4.

During the circulation operation, the subtank 3 has therein a negative pressure due to the action by the main pump 4 while the space in the common liquid chamber 26 has, by being communicated with air via the ejection port 1*a* as described above, a pressure that is almost equal to the atmospheric pressure. When there is a differential pressure between the subtank 3 and the common liquid chamber 26 as described above, there is a possibility where, when the main pump 4 is stopped, the negative pressure in the subtank 3 is transmitted to the common liquid chamber 26, causing the ejection port 1*a* to suck air.

In this embodiment, a step is provided for opening the air communication valve 6*d* immediately after the stoppage of the main pump 4 (Step S38). As a result, the pressure in the subtank 3 is recovered to the atmospheric pressure within a short period of time to eliminate the differential pressure between the subtank 3 and the common liquid chamber 26, thus preventing the ejection port 1*a* from sucking air immediately after the stoppage of the circulation operation.

Next, in order to stabilize the status in the subtank 3 and in order to provide the differential pressure between the subtank 3 and the common liquid chamber 26 to be equal to a negative pressure of a water head differential pressure in an initial status, a sufficient period of time (e.g., two seconds) is waited (Step S39).

Next, ink in an amount that was ejected in the circulation operation is supplied into the subtank 3 (Step S40), thus completing the set of steps of the circulation mode.

As described above, when the ink circulation operation in this embodiment is stopped, the air communication valve 6*d* is opened immediately after the stoppage of the main pump 4. As a result, a negative pressure in the subtank is recovered within a short period of time to eliminate the differential pressure between the subtank 3 and the common liquid chamber 26. Therefore, ink is prevented from continuously flowed due to the above differential pressure, thereby suppressing the ejection port 1*a* from sucking air.

The existence of Step S31 prior to the circulation operation for filling up ink in the subtank 3 allows the air buffer 3*f* in the subtank 3 to have an amount when ink is filled up. Specifically, an amount of the air buffer 3*f* of the subtank 3 is minimized and thus can reduce an amount of ink pushed out of the ejection port 1*a* even immediately after the start of the circulation operation in which ink tends to be pushed out of the ejection port 1*a* in a relatively easy manner. This means that an amount of waste ink is reduced when the waste ink collection tank 10 is independently provided as in this embodiment. Thus, an advantage is provided to that unnecessary exhaust of ink can be suppressed, thus reducing the running cost.

Embodiment 2

Figure 7:
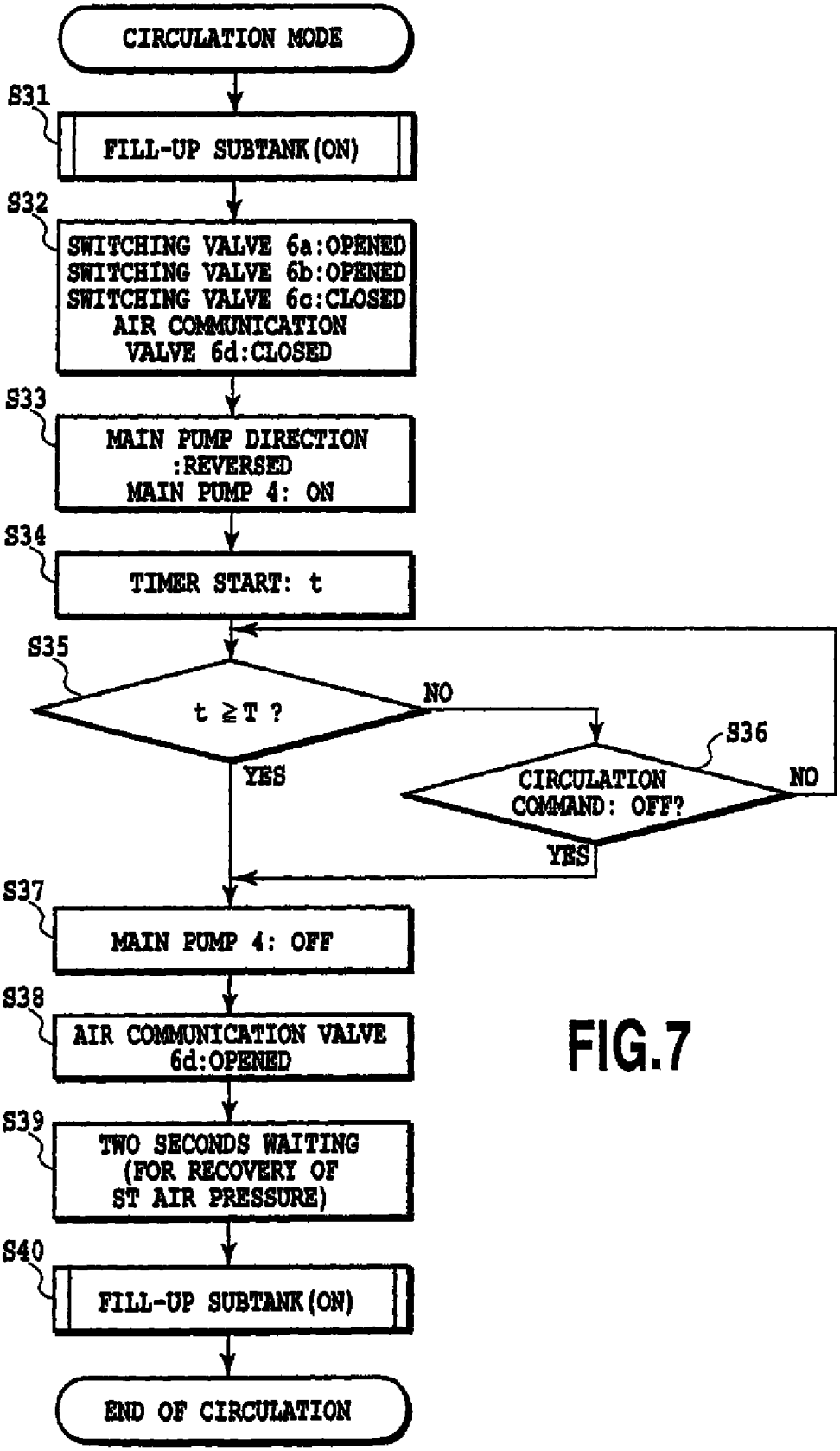
FIG. 7 shows a flowchart of a circulation mode according to a first embodiment.
Figure 8:
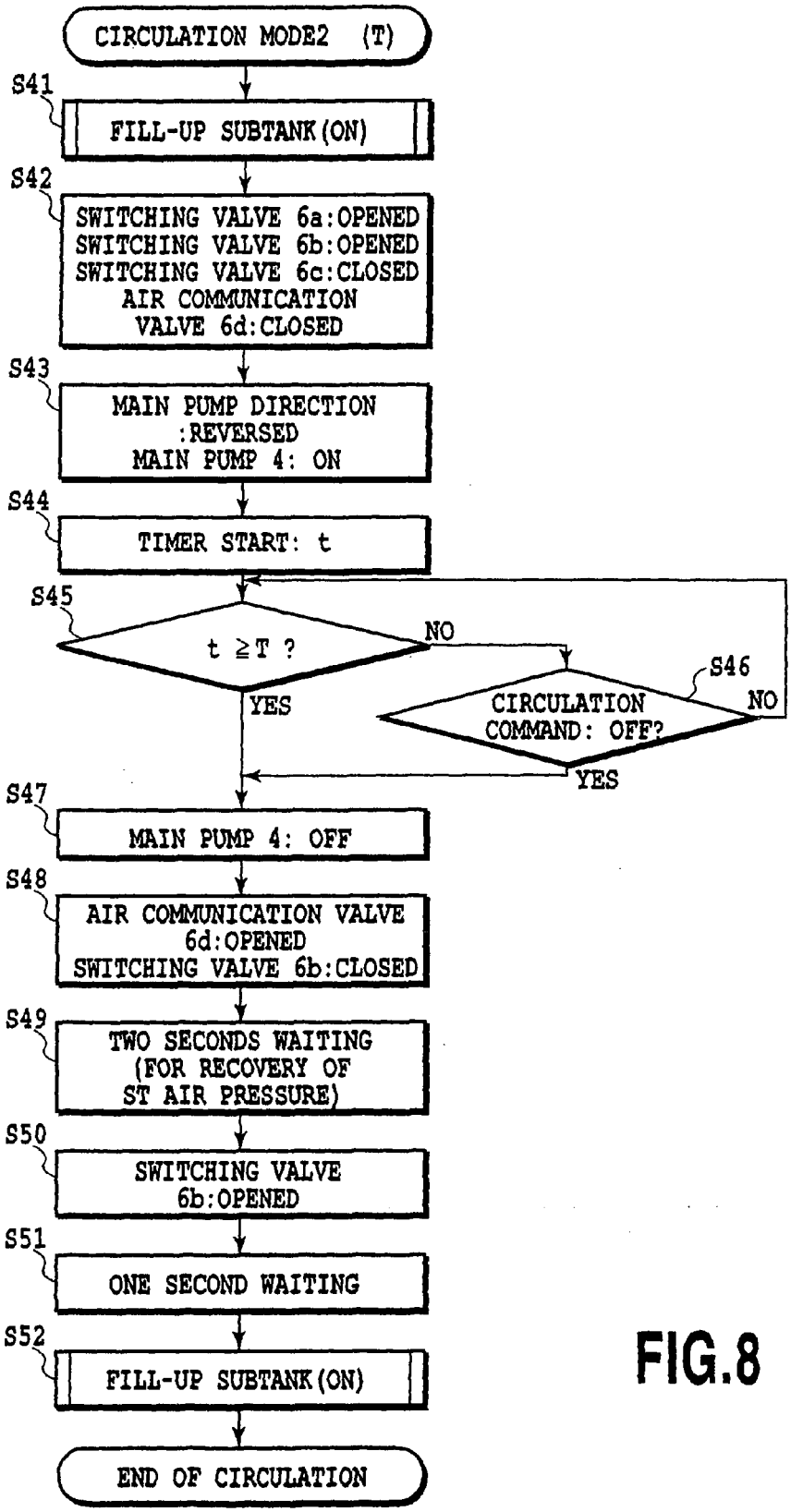
FIG. 8 shows a flowchart of a circulation mode according to a second embodiment.
Figure 9:
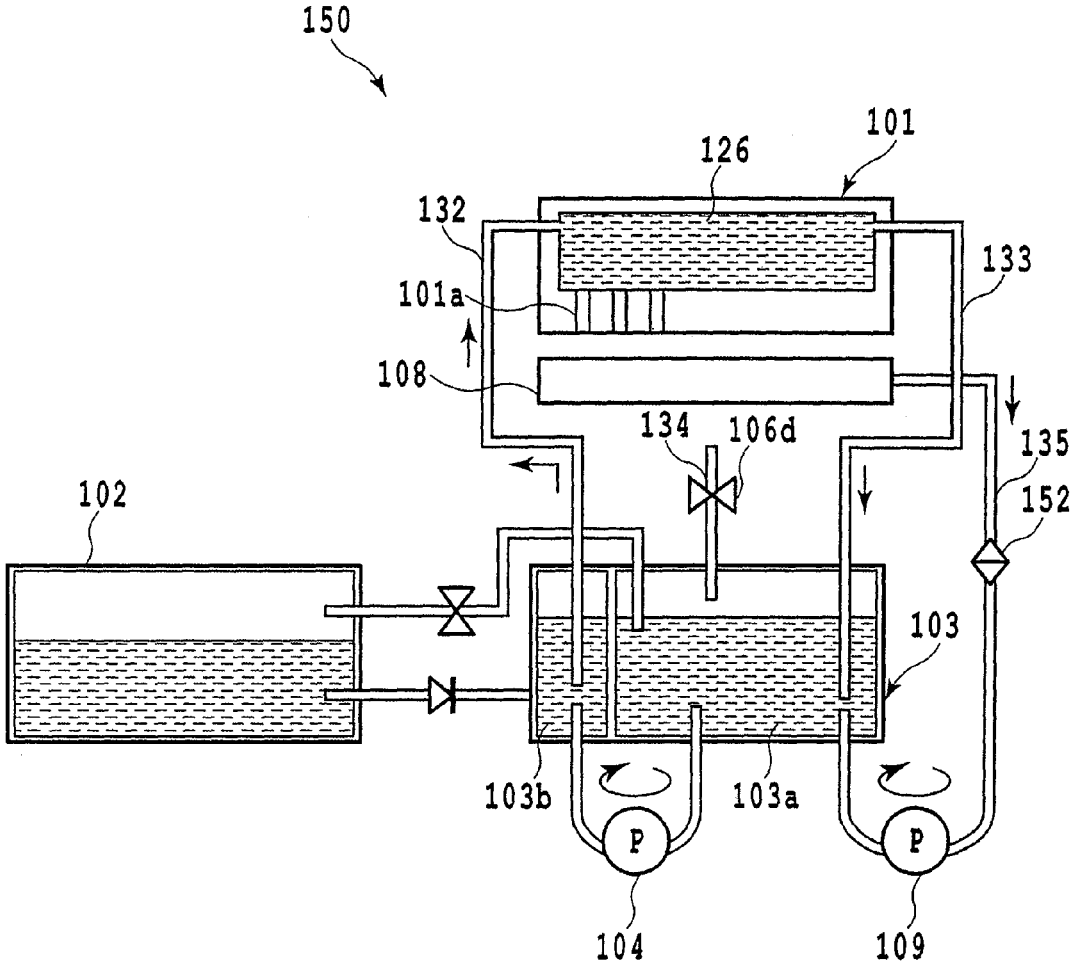
FIG.9 (PRIOR ART)
FIG. 9 is a cross-sectional view schematically showing the structure of a conventional supplying ink circulation system.

The circulation operation also may be provided as shown in FIG. 8. FIG. 8 is a flowchart of the circulation operation according to Embodiment 2. The circulation operation according to Embodiment 2 includes, in addition to the steps shown in the flowchart of FIG. 7, a step for controlling a switching valve immediately after the stoppage of the main pump 4 (Step S48), a step for subsequently opening the second switching valve 6*b* (Step S50), and a step for subsequently waiting for a predetermined time (Step S51). The same steps as those of FIG. 7 will not described further.

In Embodiment 2, a control is provided as in the first embodiment in which the circulation operation is performed for "T" seconds to subsequently stop the main pump 4 (Step S47) and then the air communication valve 6*d* is opened and the second switching valve 6*b* is closed in order to eliminate the differential pressure between the subtank 3 and the common liquid chamber 26. By closing the second switching valve 6*b* to block the communication between the subtank 3 and the common liquid chamber 26 as described above, the negative pressure in the subtank 3 is not transmitted to the common liquid chamber 26 to prevent ink from being continuously flowed from the common liquid chamber 26 into the subtank 3, thereby preventing the ejection port 1*a* from sucking air.

This means that the air filter 13 can use a dust-proof material. Specifically, a dust-proof material generally has a high pressure loss and thus such a dust-proof material used in the air filter 13 may prevent the subtank 3 from sucking outside air even when only the air communication valve 6*d* is opened as in the first embodiment. In such a case, some period of time is required for the subtank 3 to have the atmospheric pressure, thus causing a possibility where ink in the common liquid chamber 26 may, during this period of time, be continuously flowed toward the subtank 3. To prevent this, a control is provided as in this embodiment in which the air communication valve 6*d* is opened and the second switching valve 6*b* is closed, thereby preventing, even when the air filter 13 uses a dust-proof material, the ejection port 1*a* from sucking air.

Next, as in Step S39 of FIG. 7, a sufficient time (e.g., two seconds) is waited in order to stabilize the status in the subtank 3 (Step S49). Next, the second switching valve 6*b* is again opened (which is the initial status) (Step S50). Then, a sufficient time (e.g., one second) is waited in order to stabilize the differential pressure between the subtank 3 and the common liquid chamber 26 (Step S51).

Next, as in the first embodiment, ink having the same amount as that of ink ejected from the ejection port in the circulation operation is supplied into the subtank 3 (Step S52), thereby completing the set of steps of the circulation mode.

According to this embodiment, the main pump 4 is stopped to subsequently open the air communication valve 6*d* and to close the second switching valve 6*b* (Step S48). As a result, an action is provided to which the air communication valve 6*d* is opened to recover the pressure in the subtank 3 and another action is provided to which the second switching valve 6*b* is closed to block the communication between the subtank 3 and the common liquid chamber 26, thereby preventing ink from continuously flowed from the common liquid chamber 26 into the subtank 3 to minimize the air sucked by the ejection port 1*a*.

It is noted that a time between Step S47 for stopping the main pump 4 and Step S48 for opening the air communication valve 6*d* is preferably determined, in an appropriate manner, depending on the characteristics of the respective components of the supplying ink circulation system 50 so that the ejection port 1*a* is prevented from sucking air or from having ink leakage therefrom.

For example, when the main pump 4 has a characteristic in which the main pump 4 after receiving a stop signal is continuously driven by inertia and when the second switching valve 6*b* for blocking the communication between the ink jet head 1 and the subtank 3 is closed too soon, the action by the main pump 4 continuously driven by inertia may pressurize the space in the supply liquid chamber 26 to push out ink therefrom. To prevent this, a step for waiting a predetermined time (e.g., 0.5 seconds) may be provided depending on the characteristic of the main pump 4.

Next, the actual result of the control based on the flowchart shown in FIG. 8 will be described. This result is obtained by using the apparatus shown in FIG. 1 to use the pressurization flow rate by the main pump 4 of 2.7 cc/sec. during the operation of the apparatus. As shown in FIG. 8, the second switching valve 6*b* is opened and the air communication valve 6*d* is closed while the main pump 4 is being operated, thereby circulating ink. After the circulation, Step 47 is switched to Step 48 with timing as described below.

Condition 1: After 0.3 seconds after the completion of the circulation supply stoppage of the main pump 4), the air communication valve 6*d* is opened and the second switching valve 6*b* is closed.

Condition 2: Simultaneously with the completion of the circulation supply (stoppage of the main pump 4), the air communication valve 6*d* is opened and the second switching valve 6*b* is closed.

Condition 3: After the completion of the circulation supply (stoppage of the main pump 4), the second switching valve 6*b* and the air communication valve 6*d* have no change in the status. Specifically, the second switching valve 6*b* is continuously opened and the air communication valve 6*d* is continuously closed.

Figure 10A:
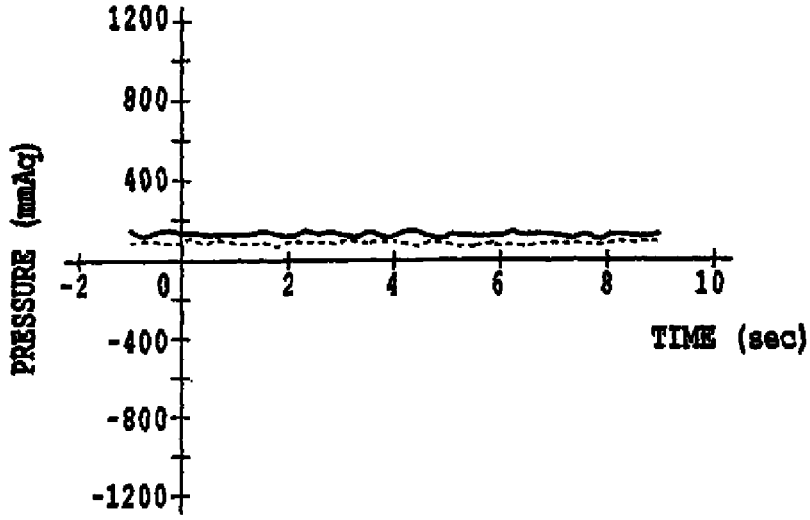
FIG. 10A is a graph showing the changes, in a method for opening an air communication valve and closing a second switching valve after 0.3 seconds of the completion of the circulation supply (stoppage of pump), of the internal pressures of the subtank and a head liquid chamber before the start of the circulation, respectively.
Figure 10B:
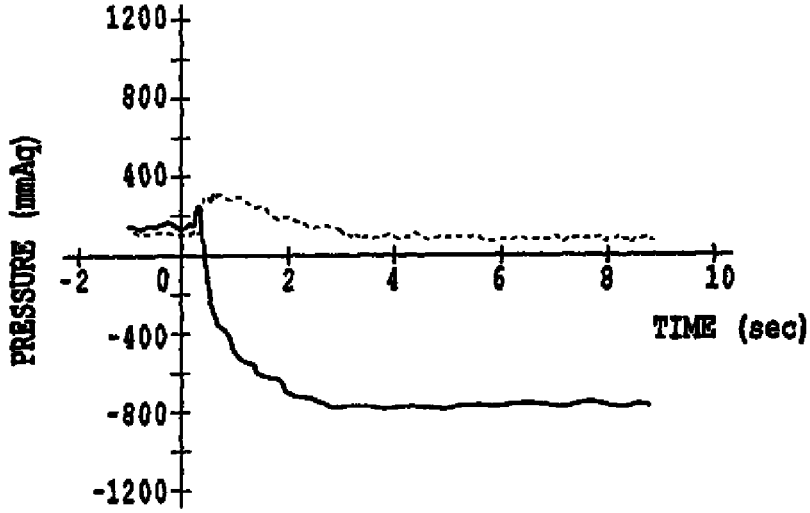
FIG. 10B is a graph showing the changes, in a method for opening the air communication valve and closing the second switching valve after 0.3 seconds of the completion of the circulation supply (stoppage of pump), of the internal pressures of the subtank and the head liquid chamber after the start of the circulation, respectively.
Figure 10C:
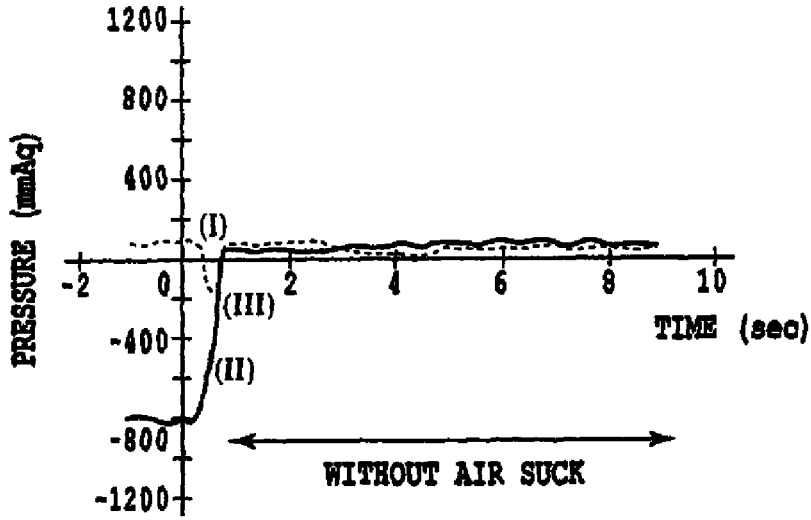
FIG. 10C is a graph showing the changes, in a method for opening the air communication valve and closing the second switching valve after 0.3 seconds of the completion of the circulation supply (stoppage of pump), of the internal pressures of the subtank and the head liquid chamber after the stoppage of the circulation, respectively.
Figure 11A:
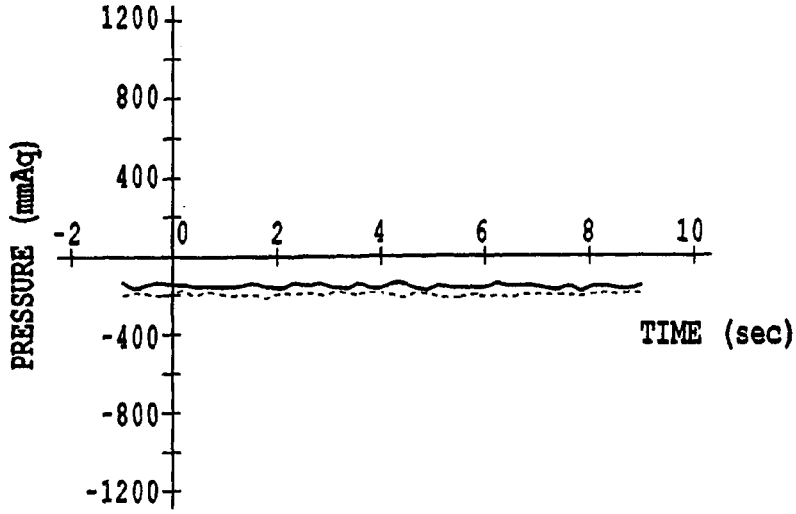
FIG. 11A is a graph showing the changes, in a method for opening the air communication valve and closing the second switching valve simultaneously with the completion of the circulation supply (stoppage of pump), of the internal pressures of the subtank and the head liquid chamber before the start of the circulation, respectively.
Figure 11B:
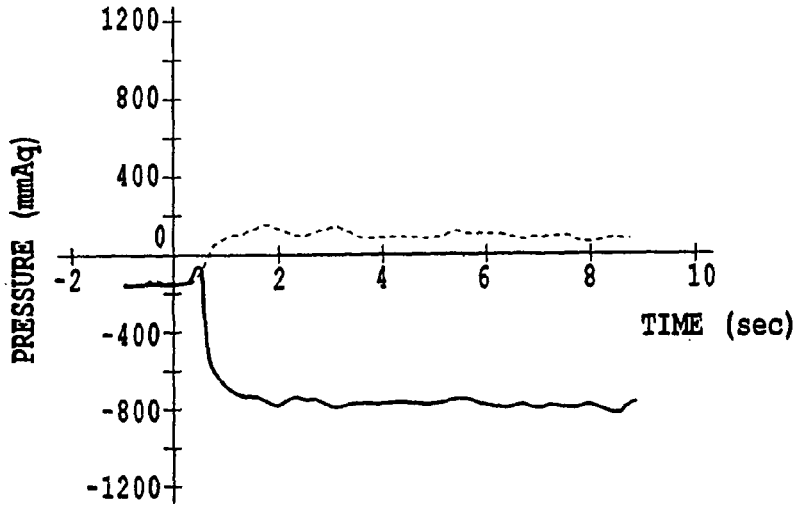
FIG. 11B is a graph showing the changes, in a method for opening the air communication valve and closing the second switching valve simultaneously with the completion of the circulation supply (stoppage of pump), of the internal pressures of the subtank and the head liquid chamber after the start of the circulation, respectively.
Figure 11C:
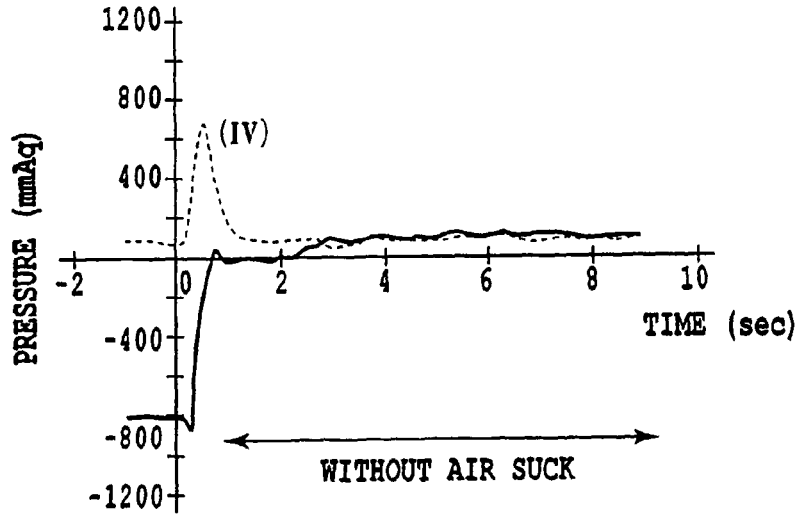
FIG. 11C is a graph showing the changes, in a method for opening the air communication valve and closing the second switching valve simultaneously with the completion of the circulation supply (stoppage of pump), of the internal pressures of the subtank and the head liquid chamber after the stoppage of the circulation, respectively.
Figure 12A:
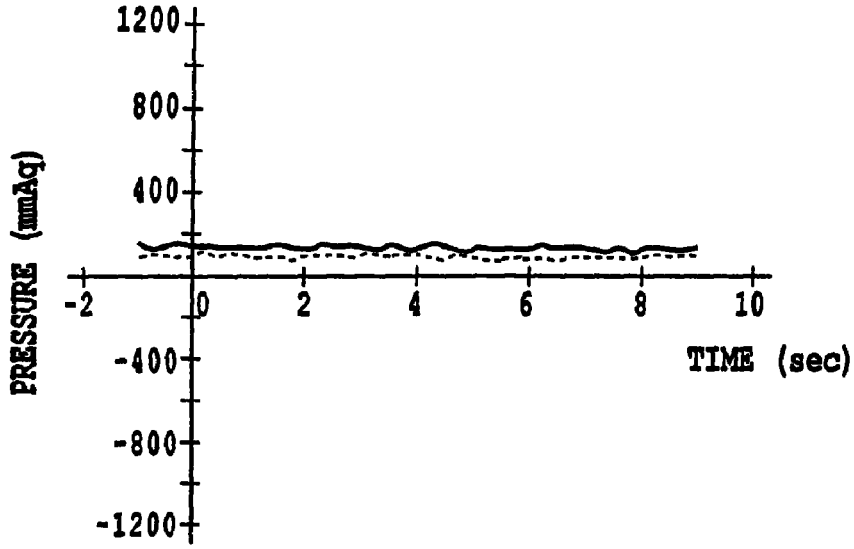
FIG. 12A is a graph showing the changes, in a method for not changing the statuses of both of the air communication valve and the second switching valve at the completion of the circulation supply (stoppage of pump), of the internal pressures of the subtank and the head liquid chamber before the start of the circulation, respectively.
Figure 12B:
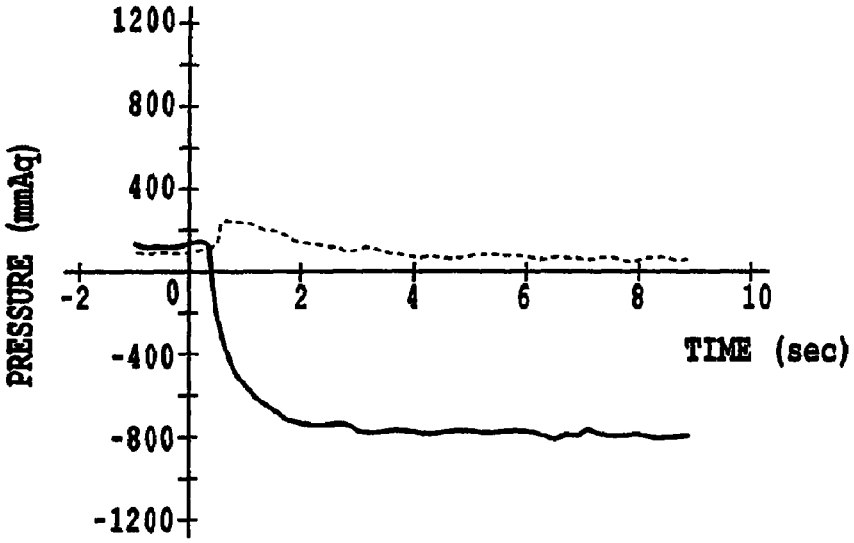
FIG. 12B is a graph showing the changes, in a method for not changing the statuses of both of the air communication valve and the second switching valve at the completion of the circulation supply (stoppage of pump), of the internal pressures of the subtank and the head liquid chamber after the start of the circulation, respectively.
Figure 12C:
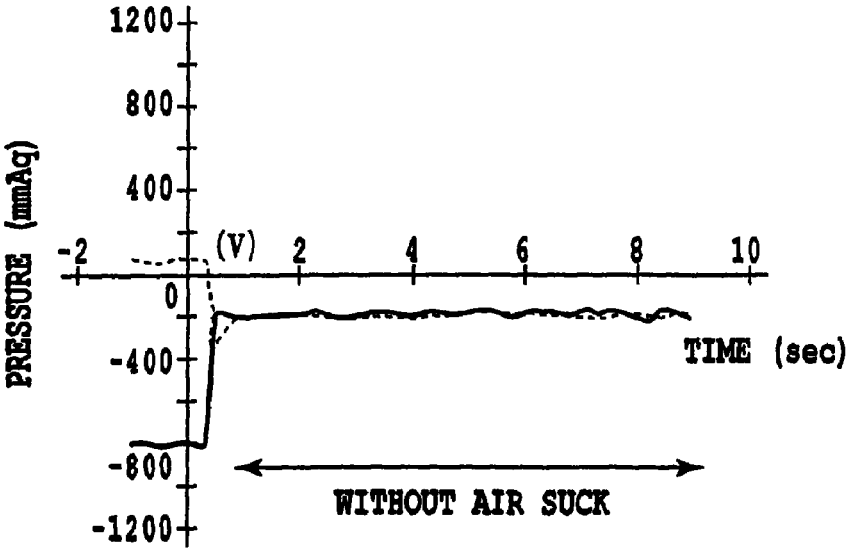
FIG. 12C is a graph showing the changes, in a method for not changing the statuses of both of the air communication valve and the second switching valve at the completion of the circulation supply (stoppage of pump), of the internal pressures of the subtank and the head liquid chamber after the stoppage of the circulation, respectively.
Figure 13A:
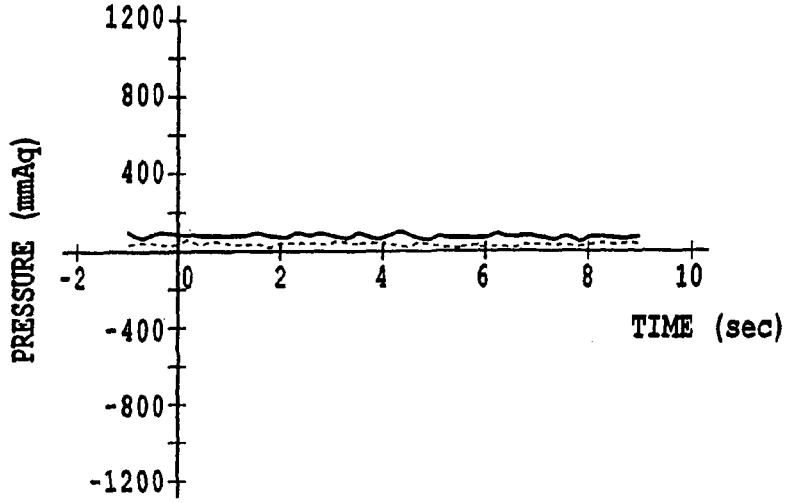
FIG. 13A is a graph showing, when the subtank includes therein air, the changes of the internal pressure of the subtank and the common liquid chamber before the start of the circulation with the same conditions as those of FIG. 10A to FIG. 10C.
Figure 13B:
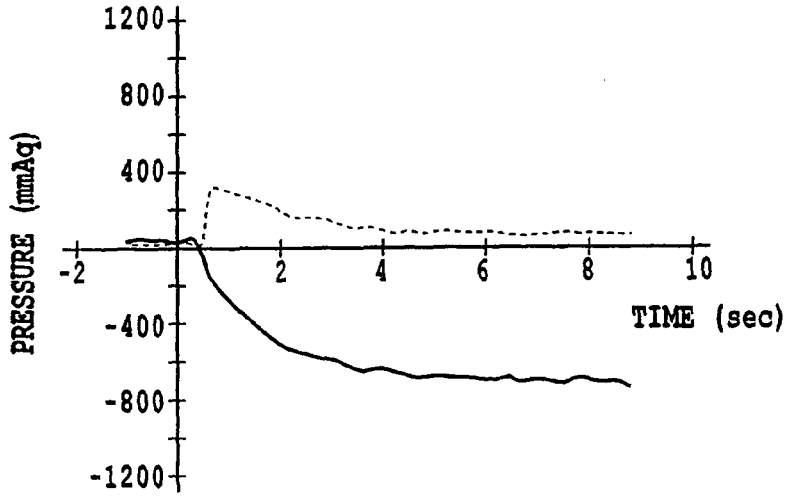
FIG. 13B is a graph showing, when the subtank includes therein air, the changes of the internal pressure of the subtank and the common liquid chamber after the start of the circulation with the same conditions as those of FIG. 10A to FIG. 10C.
Figure 13C:
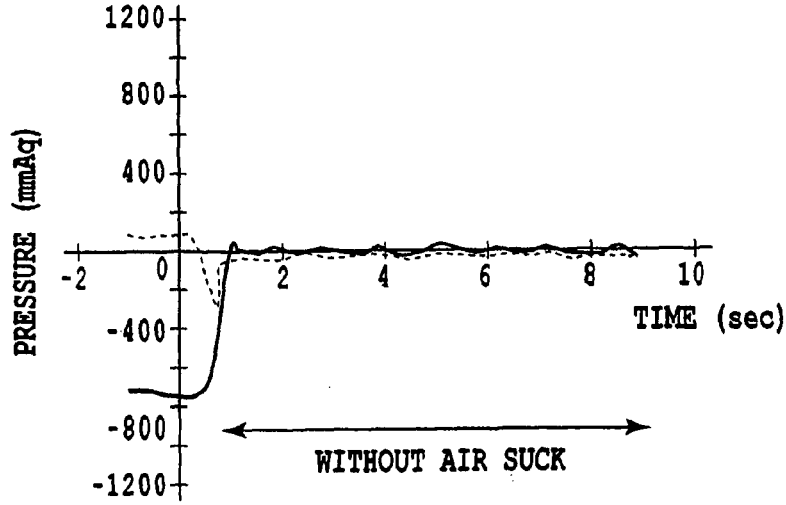
FIG. 13C is a graph showing, when the subtank includes therein air, the changes of the internal pressure of the subtank and the common liquid chamber after the stoppage of the circulation with the same conditions as those of FIG. 10A to FIG. 10C.
Figure 14A:
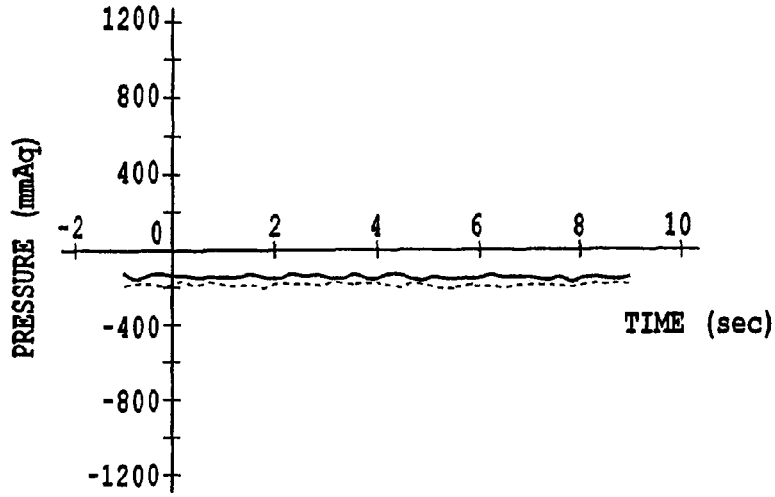
FIG. 14A is a graph showing, when the subtank includes therein air, the changes of the internal pressure of the subtank and the common liquid chamber before the start of the circulation with the same conditions as those of FIG. 11A to FIG. 11C.
Figure 14B:
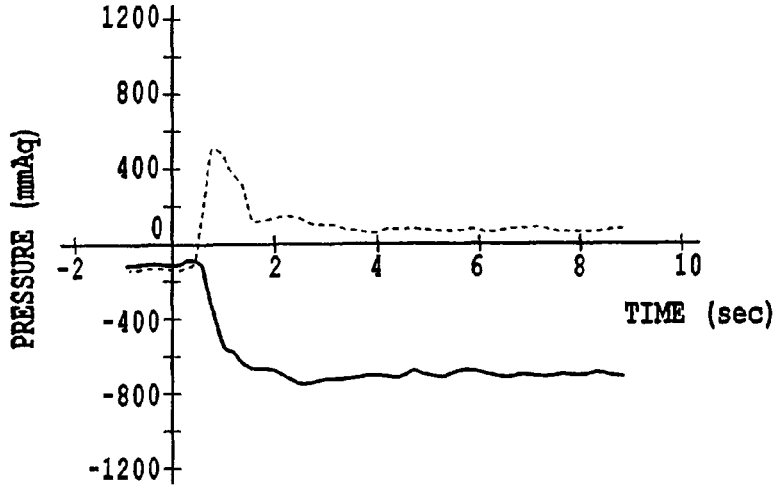
FIG. 14B is a graph showing, when the subtank includes therein air, the changes of the internal pressure of the subtank and the common liquid chamber after the start of the circulation with the same conditions as those of FIG. 11A to FIG. 11C.
Figure 14C:
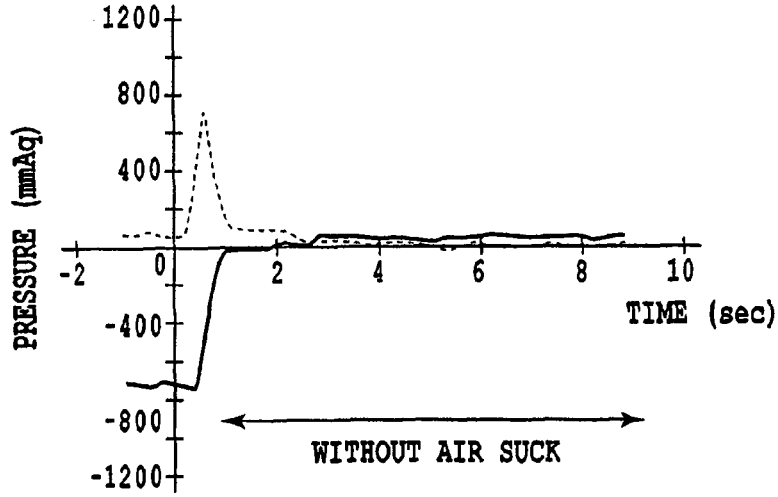
FIG. 14C is a graph showing, when the subtank includes therein air, the changes of the internal pressure of the subtank and the common liquid chamber after the stoppage of the circulation with the same conditions as those of FIG. 11A to FIG. 11C.

Under the conditions 1 to 3 as described above, the internal pressure of the subtank 3 and the internal pressure of the common liquid chamber 26 of the ink jet head 1 (shown by the broken line) were measured. The result under condition 1 is shown in FIG. 10A to FIG. 10C. The result under condition 2 is shown in FIG. 11A to FIG. 11C. The result under condition 3 is shown in FIG. 12A to FIG. 12C. In these drawings, the solid line represents the internal pressure of the subtank 3 while the broken line represents the internal pressure of the common liquid chamber 26.

FIG. 10A shows the status in the subtank 3 and in the common liquid chamber 26 before the circulation is started and shows that there is no differential pressure therebetween. FIG. 10B shows the status in which the pump operation is started and the ink circulation status is stabilized. FIG. 10C shows that, after the main pump 4 is stopped to stop the ink circulation, the air communication valve 6*d* is opened and the second switching valve 6*b* is closed when 0.3 seconds have passed as a predetermined time, which causes the pressure in the common liquid chamber 26 to be slightly decreased as shown by "I" and causes the pressure in the subtank 3 to be increased as shown by "II", immediately after which (i.e., within a time less than 1 second) the common liquid chamber 26 and the subtank 3 have almost the same pressure and are stabilized as shown by "III".

FIG. 11A and FIG. 11B show the pressure change behaviors like those shown in FIG. 10A and FIG. 10B. In FIG. 11C, the air communication valve 6*d* is opened and the second switching valve 6*b* is closed simultaneously with the stoppage of the main pump 4, thus causing the internal pressure in the common liquid chamber 26 to be increased, as shown by "IV". This is caused because ink is sent by inertia even when the main pump 4 is stopped and thus ink cannot be flowed from the ink jet head 1 to the subtank 3. When this pressure increase is high, meniscus formed in the ejection port 1*a* is broken and thus ink is pushed out of the ejection port 1*a*, thus causing the waste of ink. However, the phenomenon in which the meniscus is broken is not necessarily caused when the air communication valve 6*d* is opened and the switching valve 6*b* is closed.

FIG. 12A and FIG. 12B show the pressure change behaviors like those shown in FIG. 10A and FIG. 10B. In FIG. 12C, a control is provided to which, after the stoppage of the main pump 4, the second switching valve 6*b* is opened and the air communication valve 6*d* is closed. As a result, due to an influence by the internal pressure of the subtank 3 having a large negative pressure as shown by "V", the common liquid chamber 26 has therein a reduced internal pressure and is stabilized with a pressure that is lower than that of FIG. 12A. When this pressure is increased to have a magnitude high enough to suck the meniscus of the ejection port 1*a*, the meniscus formed in the ejection port 1*a* is broken and air is sucked into the ink jet head 1.

This tendency is always caused regardless of an amount of ink sent by the main pump 4. When the ink circulation mode is stopped, the air communication valve 6*d* is opened and the second switching valve 6*b* is closed when a predetermined time has passed since the stoppage of the main pump 4, thereby providing a control by which meniscus in the ejection port 1*a* is not moved, ink is not pushed out, or air is not sucked.

Figure 15A:
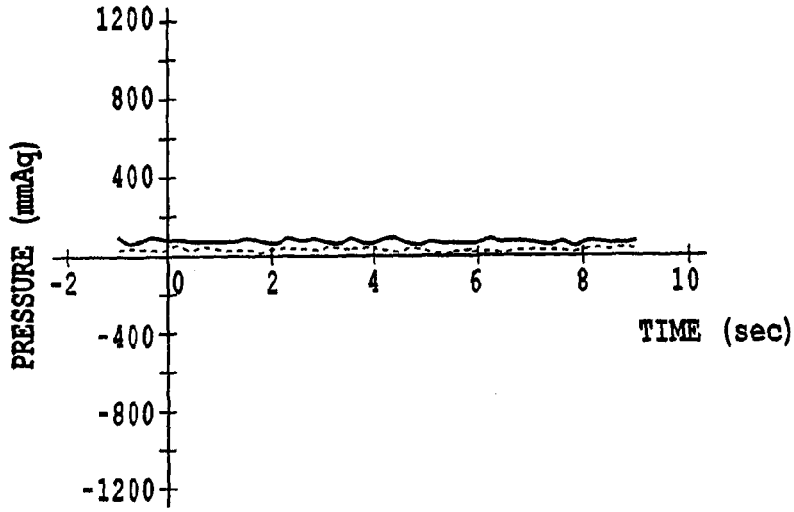
FIG. 15A is a graph showing, when the subtank includes therein air, the changes of the internal pressure of the subtank and the common liquid chamber before the start of the circulation with the same conditions as those of FIG. 12A to FIG. 12C.
Figure 15B:
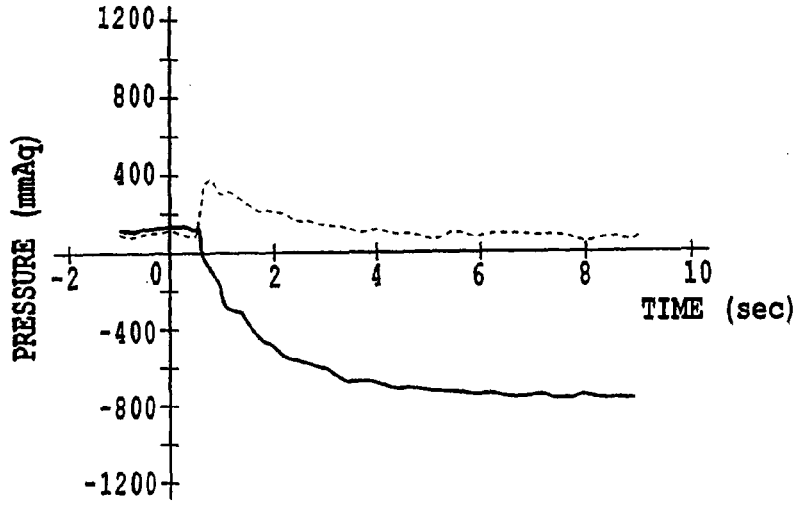
FIG. 15B is a graph showing, when the subtank includes therein air, the changes of the internal pressure of the subtank and the common liquid chamber after the start of the circulation with the same conditions as those of FIG. 12A to FIG. 12C.
Figure 15C:
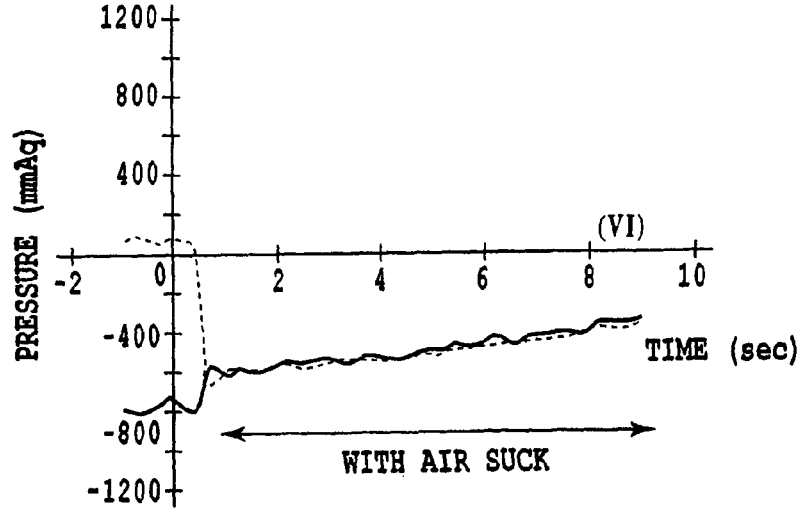
FIG. 15C is a graph showing, when the subtank includes therein air, the changes of the internal pressure of the subtank and the common liquid chamber after the stoppage of the circulation with the same conditions as those of FIG. 12A to FIG. 12C.

FIG. 13A to FIG. 15C show the results obtained by performing the conditions 1 to 3 when the subtank 3 includes therein air of about 10 cc. Although FIG. 13A to FIG. 13C and FIG. 14A to FIG. 14C show similar tendencies as those of FIG. 10A to FIG. 10C and FIG. 11A to FIG. 11C, the pressure changes are rather slower due to the existence of air in the subtank. FIG. 15C using the condition 3 shown in FIG. 15A to FIG. 15C shows a particularly severe condition in which the common liquid chamber 26 has a reduced internal pressure (negative pressure) to cause meniscus in the ejection port 1*a* to be broken to suck air as shown by "VI" (the sucked air is shown by the gradually-increasing negative pressure). Even under such a severe condition, a predetermined time can be waited after the stoppage of the main pump 4 in the circulation mode to subsequently open the air communication valve 6*d* and to close the second switching valve 6*b*, thereby providing a control in which the meniscus in the ejection port 1*a* is prevented from being moved, ink is prevented from being pushed out, and air is prevented from being sucked.

The waiting time immediately after the stoppage of the main pump 4 is a parameter that changes depending on a system configuration and thus is difficult to be specified. However, it is important to determine such a waiting time by which the air communication valve 6*d* can be opened and the second switching valve 6*b* can be closed prior to the increase or reduction in the pressure after the stoppage of the main pump 4 that may break the meniscus in the ejection port 1*a*.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2004-085600 filed Mar. 23, 2004 and 2005-044246 filed Feb. 21, 2005, which are hereby incorporated by reference herein.

What is claimed is:

1. A liquid ejection apparatus, comprising:

a head for ejecting liquid;

a subtank for storing liquid to be supplied to the head, wherein the subtank includes a space for air;

an air communication valve for opening or closing a passage for communicating air in the subtank;

a first passage for supplying liquid from the subtank to the head;

a second passage for returning liquid from the head to the subtank;

pumping means coupled to the first passage for circulating liquid between the head and the subtank; and controlling means for controlling the air communication valve and the pumping means so that the pumping means is driven after closing the air communication valve, so as to circulate liquid, and wherein the controlling means opens the air communication valve to communicate air in the subtank simultaneously with or immediately after the stoppage of the pumping means.

2. The liquid ejection apparatus as claimed in claim 1, further comprising a switching valve that is provided to the second passage for opening or closing the second passage.

3. The liquid ejection apparatus as claimed in claim 1, further comprising a main tank for storing liquid to be supplied to the subtank, a supplying passage for supplying liquid from the main tank to the subtank, and detecting means for detecting the remaining amount of liquid in the subtank, wherein when the remaining amount of liquid in the subtank detected by the detecting means is equal to or lower than a predetermined value, then the controlling means opens the air communication valve while liquid in the main tank is being supplied into the subtank.

4. The liquid ejection apparatus as claimed in claim 3, including a merging portion at which the supplying passage merges into the first passage, wherein the pumping means is provided to the first passage between the merging portion and the subtank so that liquid can be flowed in both directions.

5. The liquid ejection apparatus as claimed in claim 4, further comprising a valve for switching between a first status in which the communication between the subtank and the main tank is blocked to provide the communication between the subtank and the head and a second status in which the communication between the subtank and the head is blocked to provide the communication between the subtank and the main tank, wherein the controlling means operates the switching valve to provide the communication between the subtank and the main tank, and drives the pumping means thereby supplying liquid in the main tank into the subtank.

6. A liquid processing method in a liquid ejection apparatus which includes:

a head for ejecting liquid, a subtank for storing liquid to be supplied to the head, wherein the subtank includes a space for air, an air communication valve for opening or closing an air communication passage for communicating air in the subtank, a first passage for supplying liquid from the subtank to the head, a second passage for returning liquid from the head to the subtank, and pumping means coupled to the first passage for circulating liquid between the head and the subtank, wherein the liquid processing method comprises the steps of:

circulating liquid while driving the pumping means so as to circulate liquid; and opening the air communication valve to communicate air in the subtank simultaneously with or immediately after the stoppage of the pumping means.

7. The liquid processing method as claimed in claim 6, wherein the liquid ejection apparatus further includes a main tank for storing liquid to be supplied to the subtank and a passage for supplying liquid from the main tank to the subtank, prior to the step for circulating liquid, wherein the liquid processing method further comprises the steps of:

detecting the remaining amount of liquid in the subtank; and supplying, when the remaining amount of liquid in the subtank is equal to or lower than a predetermined value, the liquid in the main tank to the subtank while the air communication valve is open.

8. The liquid processing method as claimed in claim 7, wherein prior to the step of supplying the liquid in the main tank to the subtank, further comprising a step of blocking the communication between the subtank and the liquid ejecting head while providing the communication between the subtank and the main tank.

* * * * *